US011837174B2

(12) United States Patent
Park et al.

(10) Patent No.: US 11,837,174 B2
(45) Date of Patent: Dec. 5, 2023

(54) DISPLAY DEVICE HAVING A GRAYSCALE CORRECTION UNIT UTILIZING WEIGHTING

(71) Applicant: Samsung Display Co., LTD., Yongin-si (KR)

(72) Inventors: Jong Woong Park, Yongin-si (KR); Takeshi Kato, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/732,549

(22) Filed: Apr. 29, 2022

(65) Prior Publication Data

US 2022/0262318 A1 Aug. 18, 2022

Related U.S. Application Data

(63) Continuation-in-part of application No. 17/155,554, filed on Jan. 22, 2021, which is a continuation of (Continued)

(30) Foreign Application Priority Data

Jun. 15, 2018 (KR) ..... 10-2018-0069109
Sep. 1, 2021 (KR) ..... 10-2021-0116565

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2360/16* (2013.01)

(58) Field of Classification Search
CPC ..... G09G 3/3275
See application file for complete search history.

(56) References Cited

U.S. PATENT DOCUMENTS 5,796,409 A 8/1998 Hersch et al.
5,821,913 A 10/1998 Mamiya
(Continued)

FOREIGN PATENT DOCUMENTS

KR 10-00878216 6/2008
KR 10-1348753 1/2014
(Continued)

OTHER PUBLICATIONS

Office Action dated Jun. 22, 2022 from the Korean Patent Office for Korean Patent Application No. 20180069109.
(Continued)

*Primary Examiner* — William Boddie
*Assistant Examiner* — Andrew B Schnirel
(74) *Attorney, Agent, or Firm* — H.C. Park & Associates, PLC

(57) ABSTRACT

A display device includes dots and a grayscale correction unit. Each dot among the dots includes a first pixel of a first color, a second pixel of a second color, and a third pixel of a third color. The grayscale correction unit is configured to generate corrected grayscale values for a target dot via application of weights to grayscale values of the target dot and grayscale values of neighboring dots of the target dot among the dots. The grayscale correction unit is configured to determine the weights based on the grayscale values of the target dot.

12 Claims, 29 Drawing Sheets

Related U.S. Application Data application No. 16/379,338, filed on Apr. 9, 2019, now Pat. No. 10,902,789.

(56) References Cited

U.S. PATENT DOCUMENTS

| | | | | |
|---|---|---|---|---|
| 6,021,256 | A | 2/2000 | Ng et al. | |
| 6,542,161 | B1 | 4/2003 | Koyama et al. | |
| 7,123,277 | B2 | 10/2006 | Brown Elliott et al. | |
| 7,222,306 | B2 | 5/2007 | Kaasila et al. | |
| 7,675,492 | B2 | 3/2010 | Park et al. | |
| 10,103,205 | B2 | 10/2018 | Gu et al. | |
| 10,438,522 | B2 | 10/2019 | Hur et al. | |
| 10,902,789 | B2 | 1/2021 | Park | |
| 2005/0030302 | A1 | 2/2005 | Nishi et al. | |
| 2005/0151752 | A1 | 7/2005 | Phan | |
| 2009/0066731 | A1* | 3/2009 | Kim | G09G 5/02 345/690 |
| 2011/0050918 | A1 | 3/2011 | Tachi et al. | |
| 2012/0162528 | A1 | 6/2012 | Kiuchi et al. | |
| 2013/0076609 | A1 | 3/2013 | Inada | |
| 2013/0258145 | A1 | 10/2013 | Nakaseko | |
| 2014/0362127 | A1 | 12/2014 | Yang et al. | |
| 2016/0155396 | A1 | 6/2016 | Yang et al. | |
| 2016/0240593 | A1 | 8/2016 | Gu et al. | |

FOREIGN PATENT DOCUMENTS

| | | |
|---|---|---|
| KR | 10-2016-0069576 | 6/2016 |
| KR | 10-2016-0076207 | 6/2016 |

OTHER PUBLICATIONS

Final Office Action dated Dec. 7, 2022, in U.S. Appl. No. 17/155,554.

Final Office Action dated May 10, 2022, in U.S. Appl. No. 17/155,554.

Non-Final Office Action dated May 22, 2020, issued in U.S. Appl. No. 16/379,338.

Notice of Allowance dated Sep. 17, 2020, issued in U.S. Appl. No. 16/379,338.

Non-Final Office Action dated Oct. 20, 2021, in U.S. Appl. No. 17/155,554.

Non-Final Office Action dated Aug. 17, 2022, in U.S. Appl. No. 17/155,554.

* cited by examiner

FMTX

| SV | F11 | F12 | F13 | F21 | F22 | F23 | F31 | F32 | F33 |
|---|---|---|---|---|---|---|---|---|---|
| Smax | 0 | 0 | 0 | 0 | 1 | 0 | 0 | 0 | 0 |
| ... | ... | ... | ... | ... | ... | ... | ... | ... | ... |
| Sref | F11r | F12r | F13r | F21r | F22r | F23r | F31r | F32r | F33r |
| ... | ... | ... | ... | ... | ... | ... | ... | ... | ... |
| Smin | F11u | F12u | F13u | F21u | F22u | F23u | F31u | F32u | F33u |

DISPLAY DEVICE HAVING A GRAYSCALE CORRECTION UNIT UTILIZING WEIGHTING

CROSS-REFERENCE TO RELATED APPLICATIONS

This application is a continuation-in-part of U.S. patent application Ser. No. 17/155,554, filed Jan. 22, 2021, which is a continuation of U.S. patent application Ser. No. 16/379,338, filed on Apr. 9, 2019, and claims priority to Korean Patent Application Nos. 10-2018-0069109, filed on Jun. 15, 2018 and 10-2021-0116565 filed on Sep. 1, 2021, each of which is hereby incorporated by reference for all purposes as if fully set forth herein.

BACKGROUND

Field

One or more embodiments generally relate to a display device.

Discussion

With the development of information technology, the importance of display devices, which are a connection medium between users and information, has been emphasized. In response, the use of display devices, such as a liquid crystal display device, an organic light emitting display device, a plasma display device, and the like, has been increasing.

A display device typically writes a data voltage corresponding to each pixel, and, thereby, causes each pixel to emit light. Each pixel emits light with a luminance corresponding to the written data voltage. The pixels of adjacent different single-color hues can be grouped and the unit of such a group can be defined as a dot. Each dot can represent more colors by a combination of the single-color hues. Pictures, characters, etc. of image frames can be expressed in dot units. It is noted, however, that because the dots have a larger size than the pixels, aliasing in pictures, characters, etc. of the image frames expressed in dot units can be viewed by a user.

The above information disclosed in this section is only for understanding the background of the inventive concepts, and, therefore, may contain information that does not form prior art.

SUMMARY

One or more embodiments provide a display device capable of displaying an image frame in which aliasing is relaxed with respect to various pixel arrangement structures.

One or more embodiments provide a method of driving a display device, the method being capable of causing the display device to display an image frame in which aliasing is relaxed with respect to various pixel arrangement structures.

Additional aspects will be set forth in the detailed description which follows, and, in part, will be apparent from the disclosure, or may be learned by practice of the inventive concepts.

According to an embodiment, a display device includes dots and a grayscale correction unit. Each dot among the dots includes a first pixel of a first color, a second pixel of a second color, and a third pixel of a third color. The grayscale correction unit is configured to generate corrected grayscale values for a target dot via application of weights to grayscale values of the target dot and grayscale values of neighboring dots of the target dot among the dots. The grayscale correction unit is configured to determine the weights based on the grayscale values of the target dot.

According to an embodiment, a method of driving a display device includes: receiving grayscale values of a target dot and grayscale values of neighboring dots of the target dot among dots of the display device, each dot among the dots including a first pixel of a first color, a second pixel of a second color, and a third pixel of a third color; determining weights based on the grayscale values of the target dot; and generating corrected grayscale values for the target dot by applying the weights to the grayscale values of the target dot and the grayscale values of the neighboring dots of the target dot.

The foregoing general description and the following detailed description are illustrative and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF SOME EMBODIMENTS

Figure 1:
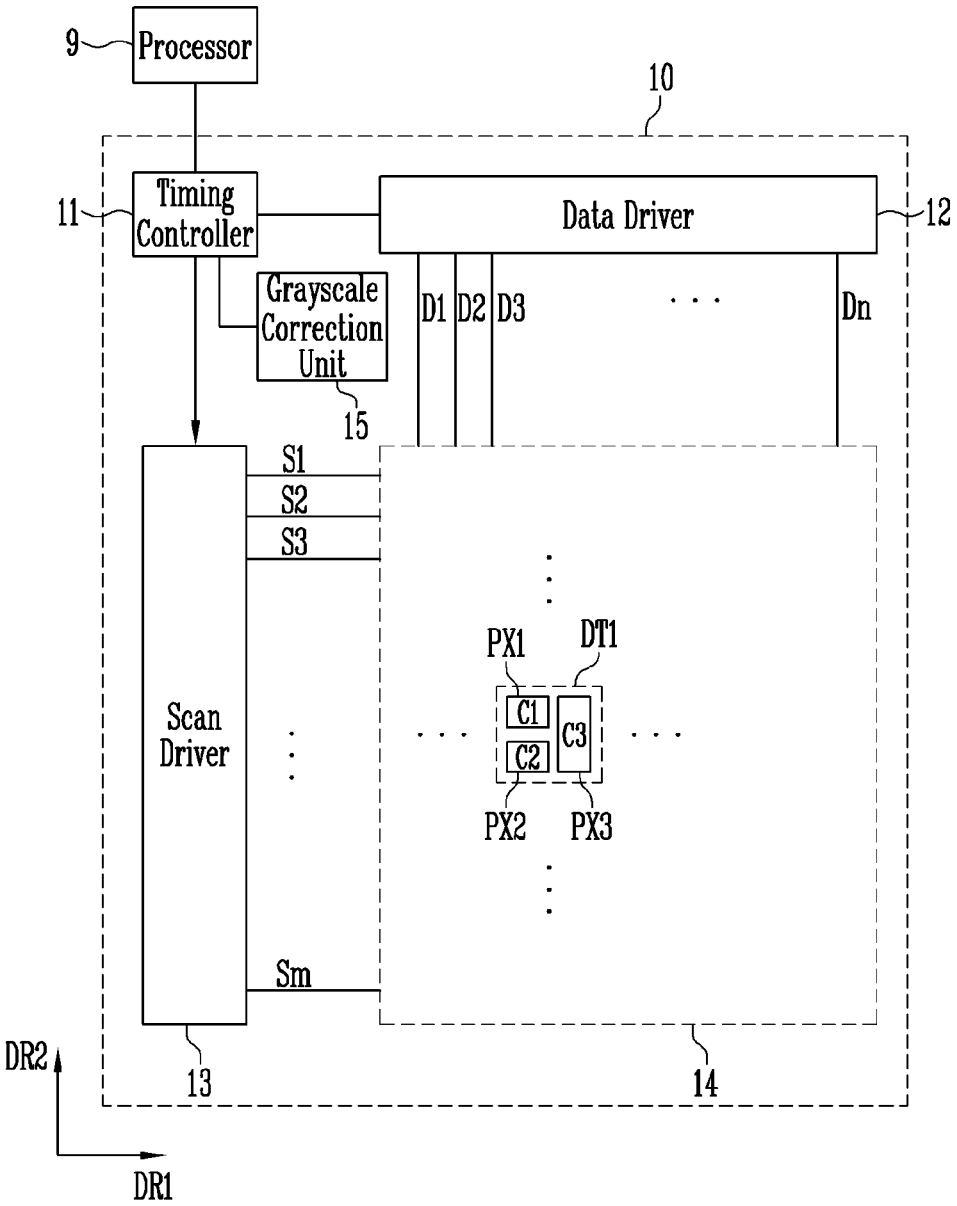
FIG. 1 is a block diagram of a display device according to an embodiment.

In the following description, for the purposes of explanation, numerous specific details are set forth in order to provide a thorough understanding of various embodiments. As used herein, the terms "embodiments" and "implementations" may be used interchangeably and are non-limiting examples employing one or more of the inventive concepts disclosed herein. It is apparent, however, that various embodiments may be practiced without these specific details or with one or more equivalent arrangements. In other instances, well-known structures and devices are shown in block diagram form to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing example features of varying detail of some embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. In addition, the DR1-axis, the DR2-axis, and the DR3-axis are not limited to three axes of a rectangular coordinate system, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing some embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the inventive concepts. Further, the blocks, units, and/or modules of some embodiments may be physically combined into more complex blocks, units, and/or modules without departing from the inventive concepts.

Hereinafter, various embodiments will be explained in detail with reference to the accompanying drawings.

FIG. 1 is a block diagram of a display device 10 according to an embodiment.

Referring to FIG. 1, the display device 10 according to an embodiment may include a timing controller 11, a data driver 12, a scan driver 13, a pixel unit 14, and a grayscale correction unit 15.

A processor 9 may be a general-purpose processing device. For example, the processor 9 may be an application processor (AP), a central processing unit (CPU), a graphics processing unit (GPU), a micro controller unit (MCU), or another host system.

The processor 9 may provide control signals for displaying an image frame and grayscale values for each pixel to the timing controller 11. The control signals may include, for example, a data enable signal, a vertical synchronization signal, a horizontal synchronization signal, a target maximum luminance, and/or the like.

The timing controller 11 may provide a clock signal, a scan start signal, and the like to the scan driver 13 so as to conform to specifications of the scan driver 13 based on the received control signals. In addition, the timing controller 11 may provide the data driver 12 with grayscale values and control signals that have been modified or maintained to conform to specifications of the data driver 12 based on the received grayscale values and control signals.

The data driver 12 may generate data voltages to be provided to data lines D1, D2, D3, . . . , Dn using the grayscale values and the control signals received from the timing controller 11. For example, the data voltages generated in units of pixel rows may be simultaneously applied to the data lines D1 to Dn according to output control signals included in the control signals.

The scan driver 13 may receive the control signals such as a clock signal, a scan start signal, and the like from the timing controller 11 and may generate scan signals to be supplied to the scan lines S1, S2, S3, . . . , and Sm. For example, the scan driver 13 may sequentially provide turn-on level scan signals to the scan lines S1 to Sn. For example, the scan driver 13 may be configured in the form of a shift register and may generate scan signals in a manner that sequentially transfers the scan start signal to the next stage circuit under the control of the clock signal.

The pixel unit 14 may include pixels, such as pixels PX1, PX2, and PX3. Each pixel, such as pixels PX1, PX2, and PX3, may be connected to a corresponding data line and a corresponding scan line. For example, when the data voltages for one pixel row are applied to the data lines D1 to Dn from the data driver 12, the data voltages may be written to the pixel row connected to the scan line supplied with the scan signal of a turn-on level from the scan driver 13. This driving method will be described in more detail with reference to FIGS. 2 and 3.

Each pixel, such as pixels PX1, PX2, and PX3, may emit light of a single color. For example, a first pixel PX1 may emit light of a first color C1, a second pixel PX2 may emit light of a second color C2, and a third pixel PX3 may emit light of a third color C3. The color of each pixel may be determined by the size of a bandgap of an organic material of an organic light emitting diode OLED1 of FIG. 2 to be described below. The first, second, and third colors C1, C2, and C3 may be variously set according to the design of the display device 10. For example, the first, second, and third colors C1, C2, and C3 may correspond to red, green, and blue, respectively. The first, second, and third colors C1, C2, and C3 may correspond to green, red, and blue, respectively. The first, second, and third colors C1, C2, and C3 may correspond to green, blue, and red, respectively. The first, second, and third colors C1, C2, and C3 may correspond to blue, green, and red, respectively. The first, second, and third colors C1, C2, and C3 may correspond to red, blue, and green, respectively. In addition, the first, second, and third colors C1, C2, and C3 may correspond to blue, red, and green, respectively. In other embodiments, the first, second, and third colors C1, C2, and C3 may optionally correspond to cyan, magenta, and yellow. In still other embodiments, alternative or additional colors may be utilized.

The third pixel PX3 may be located in a first direction DR1 from the first pixel PX1 and the second pixel PX2, and the first pixel PX1 may be located in a second direction DR2 from the second pixel PX2. Hereinafter, positions of the pixels PX1, PX2, and PX3 will be described with reference to the light emitting regions of the pixels PX1, PX2, and PX3. Circuit regions of the pixels PX1, PX2, and PX3 may not coincide with the corresponding light emitting regions.

A first dot DT1 may be defined as a group of the first pixel PX1, the second pixel PX2, and the third pixel PX3. Such a pixel layout structure may be referred to as an S-stripe structure. Unlike the RGB-stripe structure to be described below, the S-stripe structure is advantageous in securing an aperture ratio of a fine metal mask (FMM) used in one or more deposition processes of the organic light emitting diode. For instance, the interval between the pixels of the same color can be increased.

The grayscale correction unit 15 may generate a first corrected grayscale value and a second corrected grayscale value based on a first grayscale value and a second grayscale value for the first pixel PX1 and the second pixel PX2 when the first dot DT1 is determined as an edge of an object included in the image frame. At this time, the timing controller 11 may provide the first corrected grayscale value to the first pixel PX1, the second corrected grayscale value to the second pixel PX2, and a third grayscale value not corrected to the third pixel PX3. As such, the data driver 12 may supply a first data voltage corresponding to the first corrected grayscale value to the first pixel PX1, a second data voltage corresponding to the second corrected grayscale value to the second pixel PX2, and a third data voltage corresponding to the third grayscale value to the third pixel PX3. Various embodiments of the grayscale correction unit 15 will be described below with reference to FIGS. 11 to 18.

In one embodiment, the grayscale correction unit 15 and the timing controller 11 may exist as independent individual chips. In another embodiment, the grayscale correction unit 15 and the timing controller 11 may exist as an integrated single chip. For example, the grayscale correction unit 15 and the timing controller 11 may exist as a single integrated circuit (IC).

Hereinafter, the display device 10 will be described on the basis of an organic light emitting display device. However, those skilled in the art will understand that if a pixel circuit of FIGS. 2 and 3 is replaced, the display device 10 can also be applied to other display devices, such as a liquid crystal display device.

Figure 2:
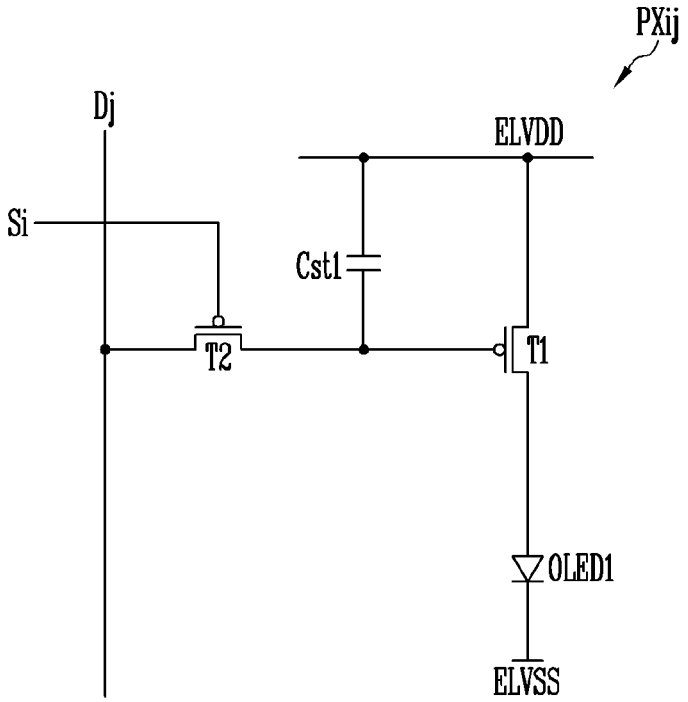
FIG. 2 is a circuit diagram of a pixel of the display device of FIG. 1 according to an embodiment.
Figure 3:
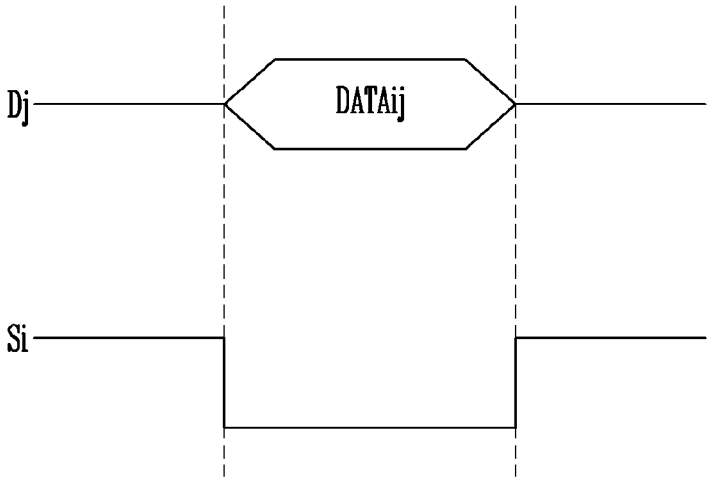
FIG. 3 is a diagram for explaining a driving method of the pixel of FIG. 2 according to an embodiment.

FIG. 2 is a circuit diagram of a pixel of the display device of FIG. 1 according to an embodiment. FIG. 3 is a diagram for explaining a driving method of the pixel of FIG. 2 according to an embodiment.

Referring to FIG. 2, a circuit structure of an exemplary pixel PXij is shown. It is assumed that the pixel PXij is connected to an arbitrary i-th scan line Si and a j-th data line Dj. The first, second and third pixels PX1, PX2, and PX3 may include a circuit structure of the pixel Pxij.

The pixel PXij may include a plurality of transistors T1 and T2, a storage capacitor Cst1, and an organic light emitting diode OLED1. Although the transistors T1 and T2 are shown as P-type transistors, those skilled in the art will recognize that a pixel circuit having the same function may be formed using N-type transistors or a combination of P-type and N-type transistors.

The transistor T2 may include a gate electrode connected to the scan line Si, one electrode connected to the data line Dj, and its other electrode connected to a gate electrode of the transistor T1. The transistor T2 may be referred to as a switching transistor, a scan transistor, or the like.

The transistor T1 may include a gate electrode connected to the other electrode of the transistor T2, one electrode connected to a first power supply voltage line ELVDD and its other electrode connected to an anode electrode of the organic light emitting diode OLED1. The transistor T1 may be referred to as a driving transistor.

The storage capacitor Cst1 may connect the one electrode and the gate electrode of the transistor T1.

The organic light emitting diode OLED1 may include an anode electrode connected to the other electrode of the transistor T1 and a cathode electrode connected to a second power supply voltage line ELVSS.

When a scan signal of a turn-on level (e.g., a low level) is supplied to the gate electrode of the transistor T2 through the scan line Si, the transistor T2 may connect the data line Dj and one electrode of the storage capacitor Cst1. As such, a voltage value corresponding to the difference between a data voltage DATAij applied through the data line Dj and the first power supply voltage is written to the storage capacitor Cst1. The transistor T1 may cause a driving current determined according to the voltage value written to the storage capacitor Cst1 to flow from the first power supply voltage line ELVDD to the second power supply voltage line ELVSS. The organic light emitting diode OLED1 may emit light with the luminance corresponding to the amount of the driving current.

Figure 4:
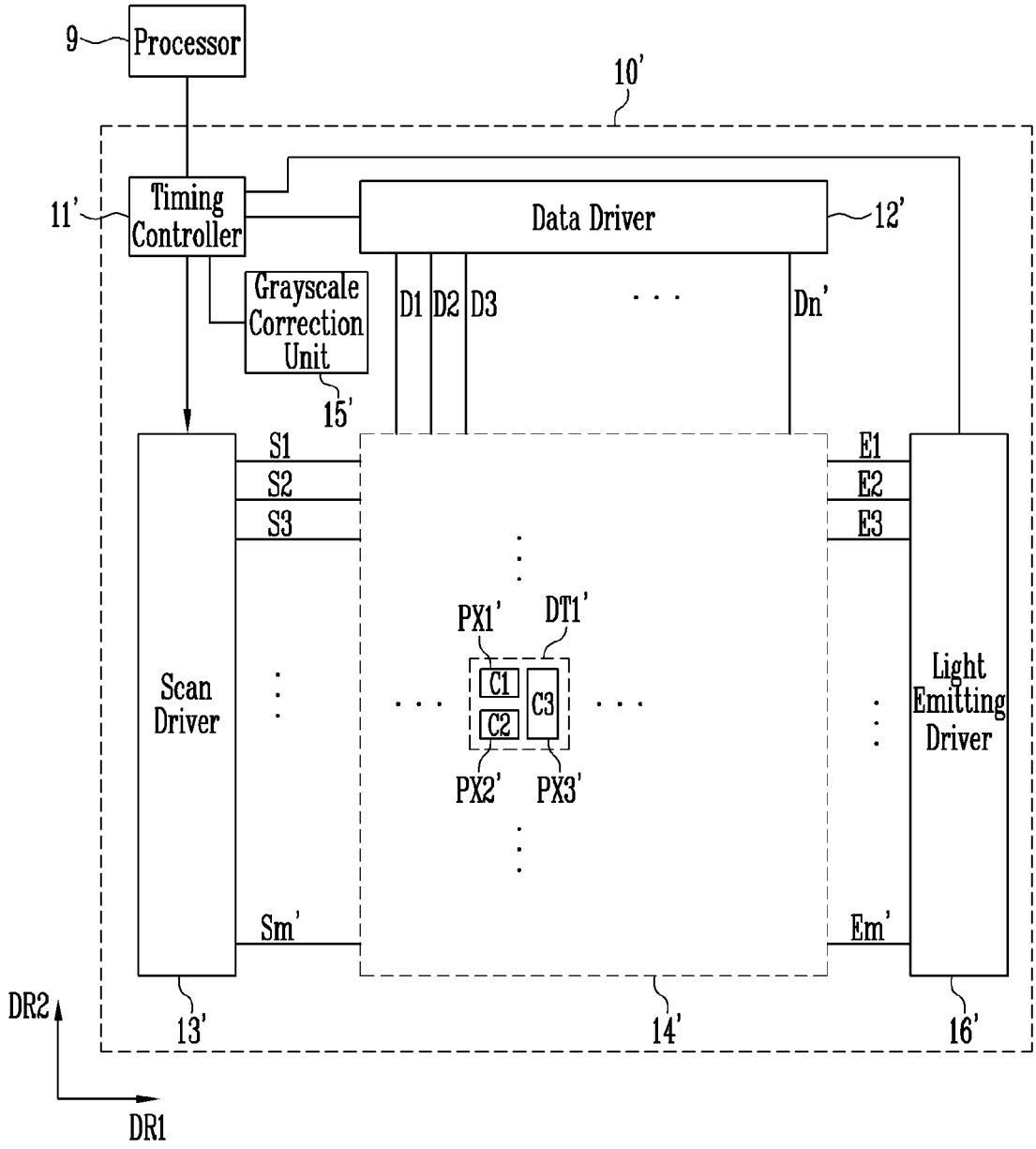
FIG. 4 is a block diagram of a display device according to an embodiment.

FIG. 4 is a block diagram of a display device 10' according to an embodiment.

Referring to FIG. 4, the display device 10' may include a timing controller 11', a data driver 12', a scan driver 13', a pixel unit 14', a grayscale correction unit 15', and a light emitting driver 16'.

Compared with the exemplary embodiment(s) described in association with FIG. 1, the display device 10' may further include the light emitting driver 16'. The other elements of the display device 10' other than the light emitting driver 16' may be the same as or similar to those of the display device 10 of FIG. 1, and thus, duplicate descriptions are omitted.

The light emitting driver 16' may supply light emitting signals for determining light emitting periods of the pixels, such as pixels PX1', PX2', and PX3', of the pixel unit 14' to light emitting lines E1, E2, E3, . . . , Em'. The light emitting driver 16' may supply the light emitting signals of a turn-off level to the light emitting lines E1 to Em' in a period in which the corresponding scan signal of the turn-on level is supplied. According to one embodiment, the light emitting driver 16' may be of a sequential light emitting type. The light emitting driver 16' may be configured in the form of a shift register and may generate the light emitting signals by sequentially transmitting light emitting start signals to the next stage circuit under the control of a clock signal. According to another embodiment, the light emitting driver 16' may be a simultaneous light emitting type in which all the pixel rows are simultaneously emitted.

Figure 5:
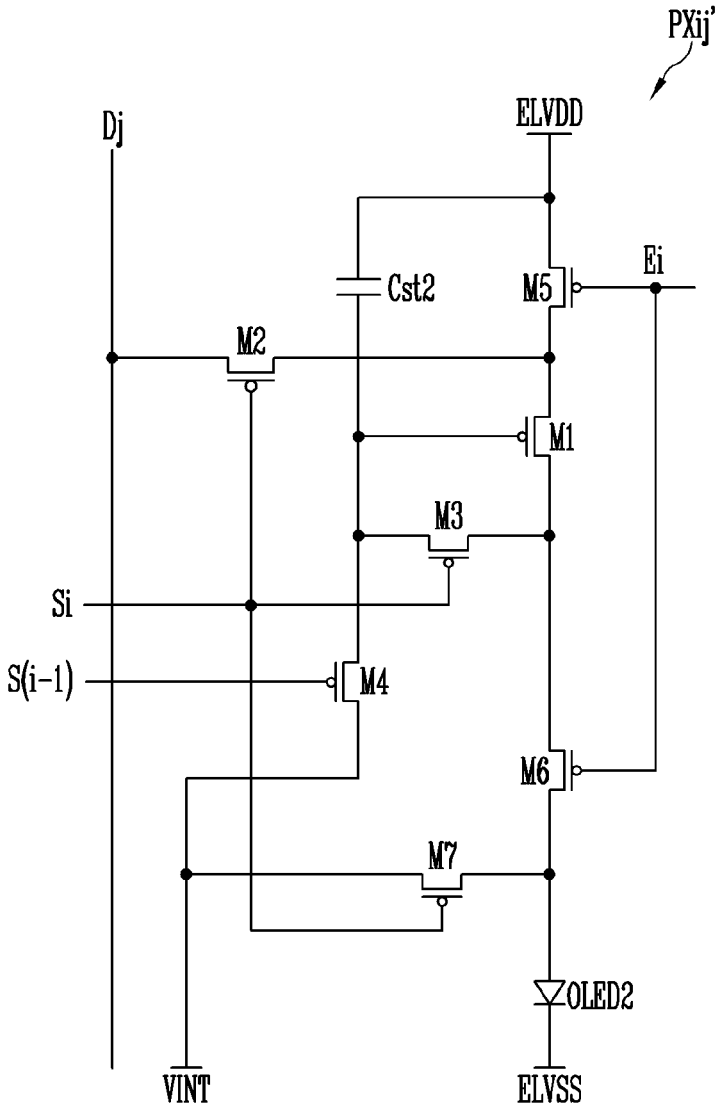
FIG. 5 is a circuit diagram of a pixel of the display device of FIG. 4 according to an embodiment.

FIG. 5 is a circuit diagram of a pixel of the display device of FIG. 4 according to an embodiment.

Referring to FIG. 5, a pixel PXij' may include transistors M1, M2, M3, M4, M5, M6, and M7, a storage capacitor Cst2, and an organic light emitting diode OLED2.

The storage capacitor Cst2 may include one electrode connected to the first power supply voltage line ELVDD and its other electrode connected to a gate electrode of the transistor M1.

The transistor M1 may include one electrode connected to the other electrode of the transistor M5, its other electrode connected to the one electrode of the transistor M6, and a gate electrode connected to the other electrode of the storage capacitor Cst2. The transistor M1 may be referred to as a driving transistor. The transistor M1 may determine the amount of driving current flowing between the first power supply voltage line ELVDD and the second power supply voltage line ELVSS according to the potential difference between its gate electrode and its source electrode.

The transistor M2 may include one electrode connected to the data line Dj, its other electrode connected to the one electrode of the transistor M1, and a gate electrode connected to the current scan line Si. The transistor M2 may be referred to as a switching transistor, a scan transistor, or the like. The transistor M2 may transfer the data voltage of the data line Dj to the pixel PXij when a scan signal of a turn-on level is applied to the current scan line Si.

The transistor M3 may include one electrode connected to the other electrode of the transistor M1, its other electrode connected to the gate electrode of the transistor M1, and a gate electrode connected to the current scan line Si. The transistor M3 may connect the transistor M1 in a diode form when a scan signal of a turn-on level is applied to the current scan line Si.

The transistor M4 may include one electrode connected to the gate electrode of the transistor M1, its other electrode connected to an initialization voltage line VINT, and a gate electrode connected to a previous scan line S(i−1). In another embodiment, the gate electrode of the transistor M4 may be connected to another scan line. The transistor M4 may transfer an initialization voltage of the initialization voltage line VINT to the gate electrode of the transistor M1 to initialize the amount of charge of the gate electrode of the transistor M1 when the scan signal of the turn-on level is applied to the previous scan line S(i−1).

The transistor M5 may include one electrode connected to the first power supply voltage line ELVDD, its other electrode connected to the one electrode of the transistor M1, and a gate electrode connected to a light emitting line Ei. The transistor M6 may include one electrode connected to the other electrode of the transistor M1, its other electrode connected to an anode electrode of the organic light emitting diode OLED2, and a gate electrode connected to the light emitting line Ei. The transistors M5 and M6 may be referred to as a light emitting transistor. The transistors M5 and M6 may form a driving current path between the first power supply voltage line ELVDD and the second power supply voltage line ELVSS when a light emitting signal of a turn-on level is applied so that the organic light emitting diode OELD2 emits light.

The transistor M7 may include one electrode connected to the anode electrode of the organic light emitting diode OLED2, the other electrode connected to the initialization voltage line VINT, and a gate electrode connected to the current scan line Si. In another embodiment, the gate electrode of the transistor M7 may be connected to another scan line. For example, the gate electrode of the transistor M7 may be connected to the next scan line (an (i+1)-th scan line) or a subsequent scan line. The transistor M7 may transfer the initialization voltage to the anode electrode of the organic light emitting diode OLED2 to initialize the amount of charge accumulated in the organic light emitting diode OELD2 when the scan signal of the turn-on level is applied to the current scan line Si.

The organic light emitting diode OELD2 may include an anode electrode connected to the other electrode of the transistor M6 and a cathode electrode connected to the second power supply voltage line ELVSS.

Figure 6:
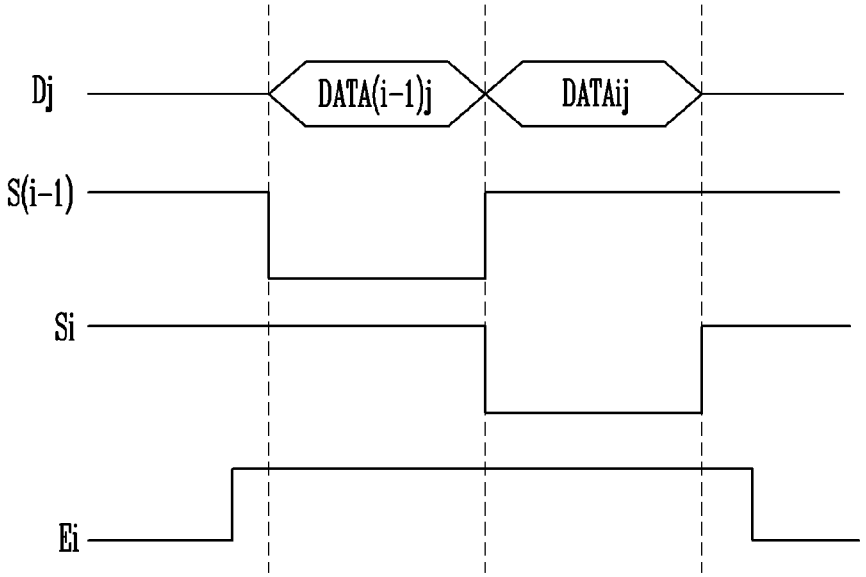
FIG. 6 is a diagram for explaining a driving method of the pixel of FIG. 5 according to an embodiment.

FIG. 6 is a diagram for explaining a driving method of the pixel of FIG. 5 according to an embodiment.

First, a data voltage DATA(i−1)j for a previous pixel row may be applied to the data line Dj and the scan signal of the turn-on level (e.g., a low level) may be applied to the previous scan line S(i−1).

Since the scan signal of the turn-off level (e.g., a high level) is applied to the current scan line Si, the transistor M2 may be turned off and the data voltage for the previous pixel row (DATA(i−1)j) may not be transferred to the pixel PXij.

At this time, since the transistor M4 is turned on, the initialization voltage may be applied to the gate electrode of the transistor M1 to initialize the amount of charge. Since a light emitting control signal of a turn-off level is applied to the light emitting line Ei, the transistors M5 and M6 may be turned off and unnecessary light emission of the organic light emitting diode OLED2 may be prevented during the initialization voltage application process.

Next, a data voltage DATAij for a current pixel row may be applied to the data line Dj and the scan signal of the turn-on level may be applied to the current scan line Si. As a result, the transistors M2, M1, and M3 may be turned on, and the data line Dj and the gate electrode of the transistor M1 may be electrically connected. As such, the data voltage DATAij may be applied to the other electrode of the storage capacitor Cst2 and the storage capacitor Cst2 may accumulate the amount of charge corresponding to the difference between the voltage of the first power supply voltage line ELVDD and the data voltage DATAij.

At this time, since the transistor M7 is turned on, the anode electrode of the organic light emitting diode OLED2 may be connected to the initialization voltage line VINT, and the organic light emitting diode OLED2 may be pre-charged or initialized with the amount of charge corresponding to the voltage difference between the initialization voltage and the voltage of the second power supply voltage line ELVSS.

Thereafter, the transistors M5 and M6 may be turned on as the light emitting signal of the turn-on level is applied to the light emitting line Ei, the amount of the driving current passing through the transistor M1 may be adjusted according to the amount of charge stored in the storage capacitor Cst2, and the driving current may flow through the organic light emitting diode OLED2. The organic light emitting diode OLED2 may emit light until the light emitting signal of the turn-off level is applied to the light emitting line Ei.

Figure 7:
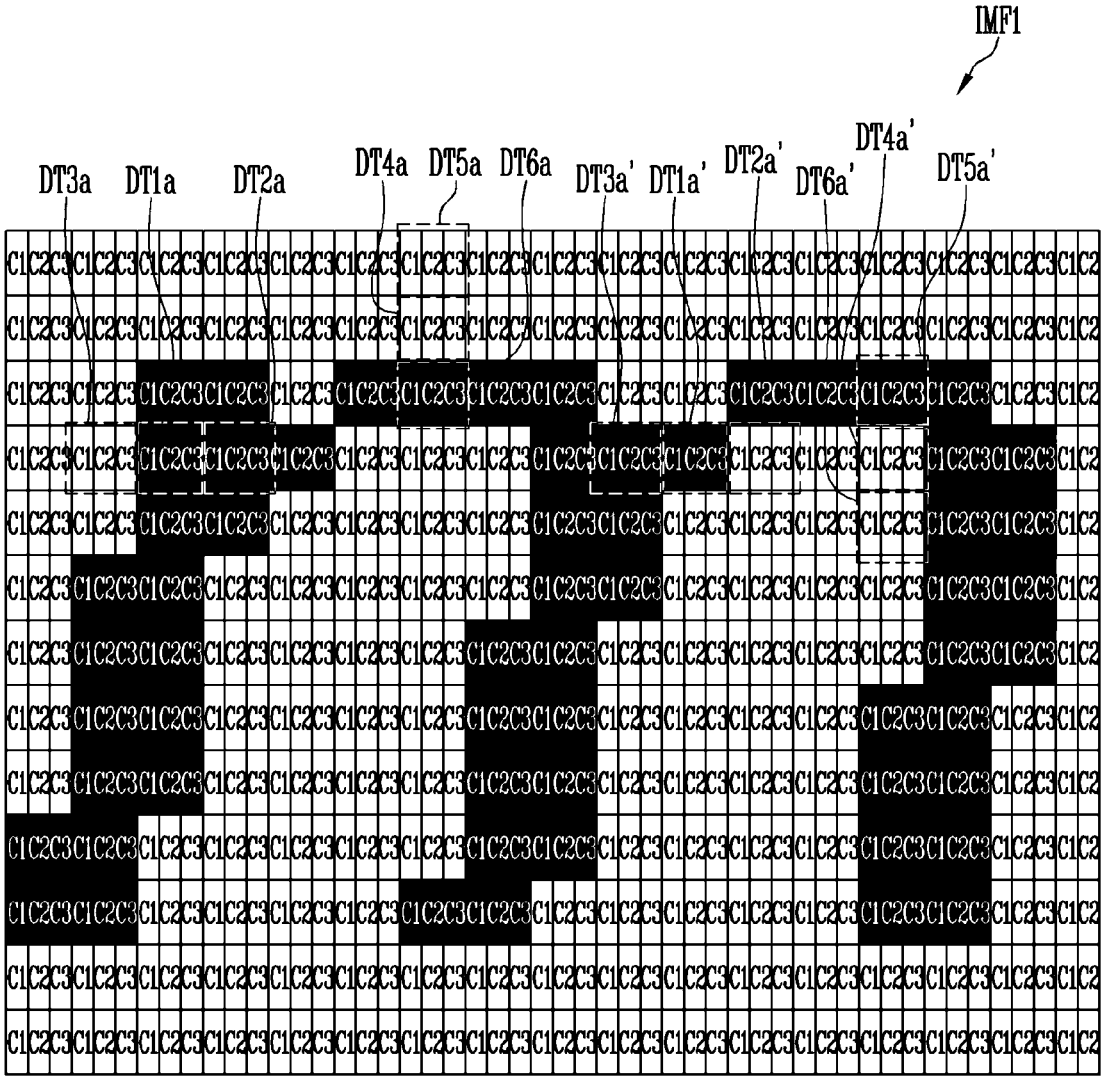
FIG. 7 is a diagram for explaining a first image frame to which anti-aliasing indicated in an RGB-stripe structure is not applied according to an embodiment.

FIG. 7 is a diagram for explaining a first image frame IMF1 to which anti-aliasing indicated in the RGB-stripe structure is not applied according to an embodiment.

The pixel unit for displaying the first image frame IMF1 of FIG. 7 may have an RGB-stripe structure unlike the embodiments described in association with FIGS. 1 and 4.

Referring to FIG. 7, each of dots, such as dots DT1*a*, DT2*a*, DT3*a*, DT4*a*, DT5*a*, DT6*a*, DT1*a*', DT2*a*', DT3*a*', DT4*a*', DT5*a*', and DT6*a*', may include a pixel of the first color C1, a pixel of the second color C2, and a pixel of the third color C3 sequentially positioned in the first direction DR1. This pixel arrangement structure may be referred to as an RGB-stripe structure.

The processor 9 may provide the timing controller 11 with the grayscale values corresponding to the pixels so that the pixels have the desired luminance level for the first image frame IMF1. For example, when a grayscale value is represented by 8 bits, 256 ($=2^5$) grayscale levels can be expressed in each pixel. The number of bits representing each grayscale value may be varied according to the specification of the processor 9 or the display device 10.

The processor 9 may provide grayscale values for the pixels to the timing controller 11 to display a character in the first image frame IMF1. Thus, the dots, such as dots DT1*a*, DT2*a*, DT6*a*, DT3*a*', DT1*a*', and DT5*a*', constituting the character can display black color and the dots, such as dots DT3*a*, DT4*a*, DT6*a*, DT2*a*', DT3*a*', and DT6*a*', that do not constitute the character can display white color.

For example, the processor 9 may provide all the grayscale values of the pixels included in the black dots as "0" and the grayscale values of the pixels included in the white dots as "255".

However, because the dots have a larger size than the pixels, aliasing in the first image frame IMF1 in which a character is expressed in dot units may be viewed by the user.

Figure 8:
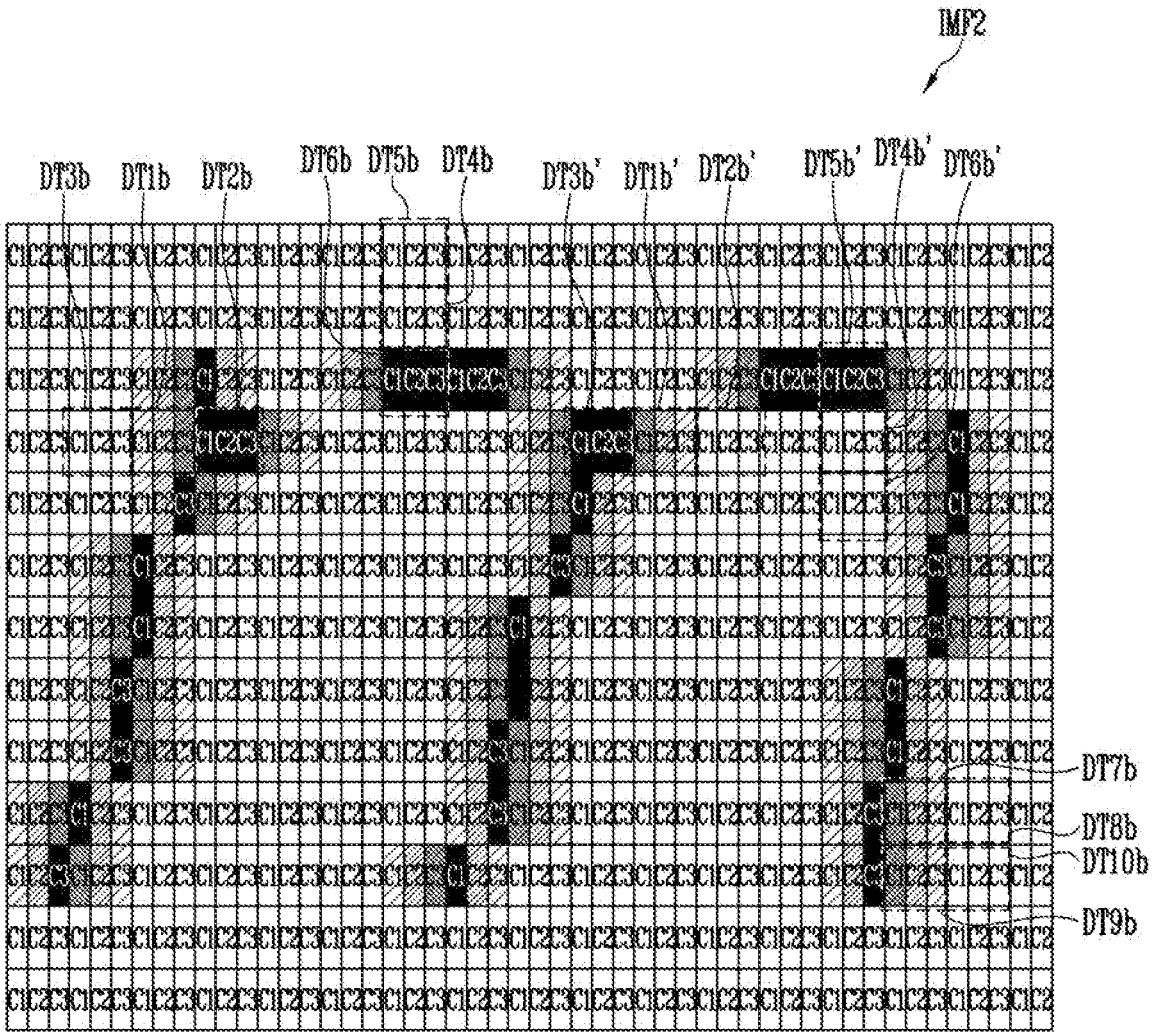
FIG. 8 is a diagram for explaining a second image frame to which anti-aliasing indicated in an RGB-stripe structure is applied according to an embodiment.
Figure 9:
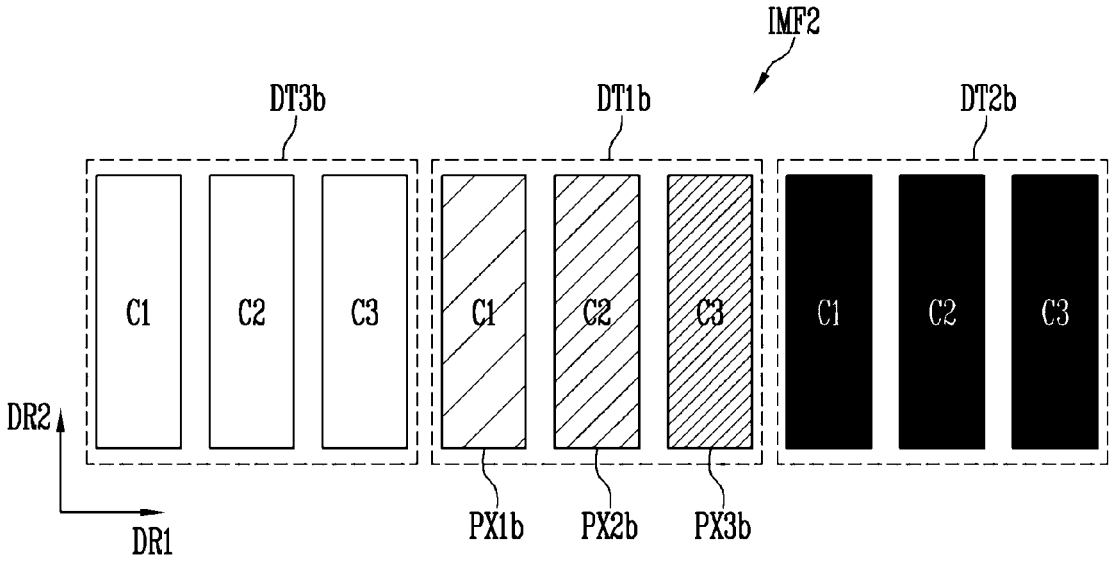
FIG. 9 is an enlarged view of the first to third dots of FIG. 8 according to an embodiment.

FIG. 8 is a diagram for explaining a second image frame to which anti-aliasing indicated in the RGB-stripe structure is applied according to an embodiment. FIG. 9 is an enlarged view of the first to third dots of FIG. 8 according to an embodiment.

The pixel unit for displaying a second image frame IMF2 of FIG. 8 may have an RGB-stripe structure unlike the embodiments of FIGS. 1 and 4. The structure of the pixel unit of FIG. 8 may be the same as that of the pixel unit of FIG. 7.

Referring FIG. 8, each of dots, such as dots DT1*b*, DT2*b*, DT3*b*, DT4*b*, DT5*b*, DT6*b*, DT1*b*', DT2*b*', DT3*b*', DT4*b*', DT5*b*', and DT6*b*', may include a pixel of the first color C1, a pixel of the second color C2, and a pixel of the third color C3 sequentially positioned in the first direction DR1.

The processor 9 may provide grayscale values for the second image frame IMF2 applied with anti-aliasing to the character of the first image frame IMF1 to the timing controller 11. The font of the character of the second image frame IMF2 of FIG. 8 may be different from that of the character of the first image frame IMF1 of FIG. 7. In one embodiment, the processor 9 does not convert the character of the first image frame IMF1 into the character of the second image frame IMF2 through a separate process and can include the character of the specific font whose grayscale values are determined so that the anti-aliasing effect appears in the second image frame IMF2. For example, a clear-type font provided in Windows™ may correspond to this embodiment. In another embodiment, the processor 9 may transform the grayscale values of the character of the first image frame IMF1 through an anti-aliasing algorithm to generate grayscale values of the character of the second image frame IMF2.

The processor 9 may provide grayscale values to the timing controller 11 so that the pixels of the dots DT1*b* and DT1*b*' constituting the edge of the character have sequentially rising or falling luminance levels. Here, the edge of the character may mean an edge located in the first direction DR1 or an edge located in a direction opposite to the first direction DR1 with respect to the character.

For example, referring to FIG. 9, the first dot DT1*b* constituting the edge of the character in the direction opposite to the first direction DR1 with respect to the character may include the first, second, and third pixels PX1*b*, PX2*b* and PX3*b*, and the processor 9 may provide first to third grayscale values so that the first, second, and third pixels PX1*b*, PX2*b*, and PX3*b* have sequentially falling luminance levels. For instance, the first to third grayscale values are different from each other, and the second grayscale value may correspond to a value between the first grayscale value and the third grayscale value. For example, the processor 9 may provide the first grayscale value of "200" to the first pixel PX1*b*, the second grayscale value of "100" to the second pixel PX2*b*, and the third grayscale value of "50" to the third pixel PX3*b*.

At this time, the processor 9 may provide the grayscale value of "255" to the pixels of the third dot DT3*b* located in the direction opposite to the first direction DR1 of the first dot DT1*b* and may provide the grayscale value of "0" to the pixels of the second dot DT2*b* located in the first direction DR1 of the first dot DT1*b*.

Similarly, the first dot DT1*b*' constituting the edge of the character in the first direction DR1 with respect to the character may include the first to third pixels, and the processor 9 may provide first to third grayscale values so that the first to third pixels have sequentially rising luminance levels. For instance, the first to third grayscale values may be different from each other, and the second grayscale value may correspond to a value between the first grayscale value and the third grayscale value. For example, the processor 9 may provide the first grayscale value of "50" to the first pixel, the second grayscale value of "100" to the second pixel, and the third grayscale value of "200" to the third pixel.

At this time, the processor 9 may provide the grayscale value of "0" to the pixels of the third dot DT3*b*' located in the direction opposite to the first direction DR1 of the first dot DT1*b*' and may provide the grayscale value of "255" to the pixels of the second dot DT2*b*' located in the first direction DR1 of the first dot DT1*b*'.

Therefore, the user can observe and perceive the character included in the second image frame IMF2 of FIG. 8 more smoothly and clearly than the character included in the first image frame IMF1 of FIG. 7.

Figure 10:
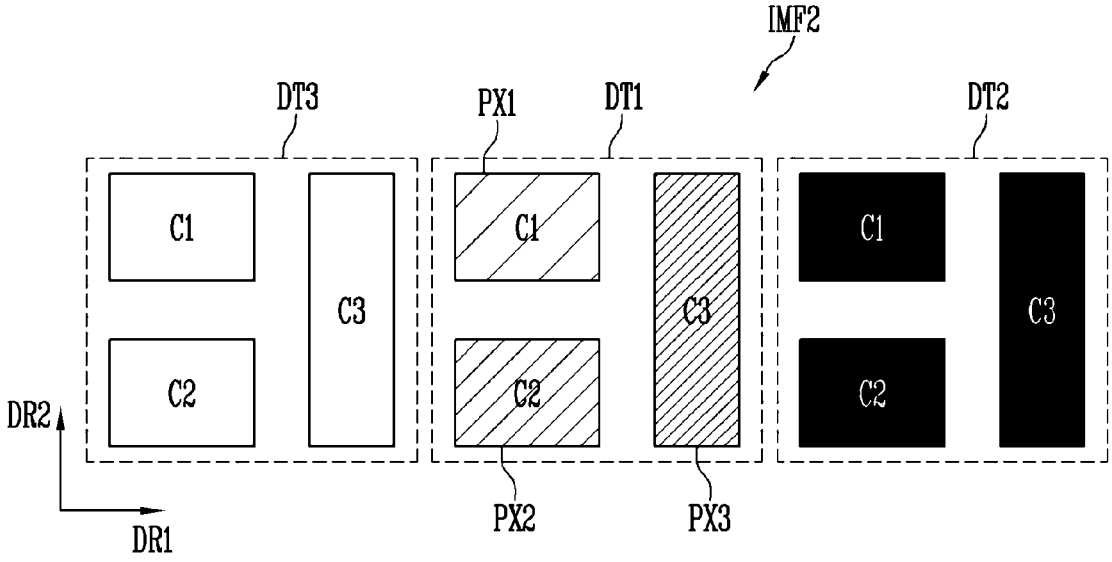
FIG. 10 is a diagram for explaining a case where a second image frame is displayed without correction in an S-stripe structure according to an embodiment.

FIG. 10 is a diagram for explaining a case where the second image frame is displayed without correction in the S-stripe structure according to an embodiment.

Referring to FIG. 10, the case where the grayscale values of the second image frame IMF2 provided by the processor 9 are applied to the pixel unit 14 of the display device 10 of FIG. 1 without correction is shown.

Since the second image frame IMF2 provided by the processor 9 is based on the RGB-stripe structure, when the grayscale values of the second image frame IMF2 are directly applied to the pixel unit 14 of the display device 10 having the S-stripe structure, the desired anti-aliasing effect cannot be obtained.

In the above example, in the second image frame IMF2, the first grayscale value of the first pixel PX1*b* may be provided as "200", the second grayscale value of the second pixel PX2*b* may be provided as "100", and the third grayscale value of the third pixel PX3*b* may be provided as "50". In this case, the first grayscale value of the first pixel PX1 located in the same column in the second direction DR2 may become "200" and the second grayscale value of the second pixel PX2 may become "100" so that the displayed character may have a serrated edge. Therefore, the first grayscale value and the second grayscale value may require correction. However, since the relative location of the third pixel PX3 in the first dot DT1 of the S-stripe structure is the same as or similar to that of the third pixel PX3*b* in the first dot DT1*b* of the RGB-stripe structure, correction of the third grayscale value may be unnecessary.

Figure 11:
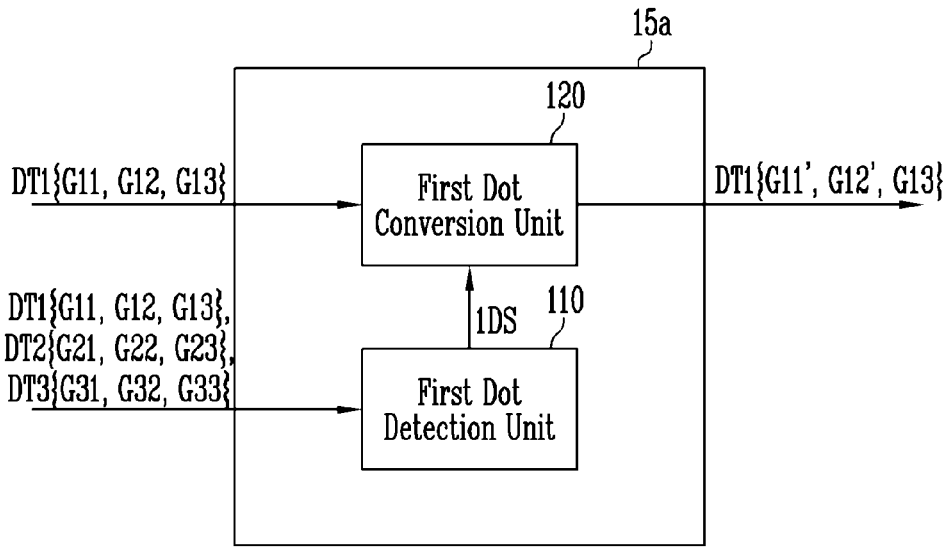
FIG. 11 is a block diagram of a grayscale correction unit according to an embodiment.
Figure 12:
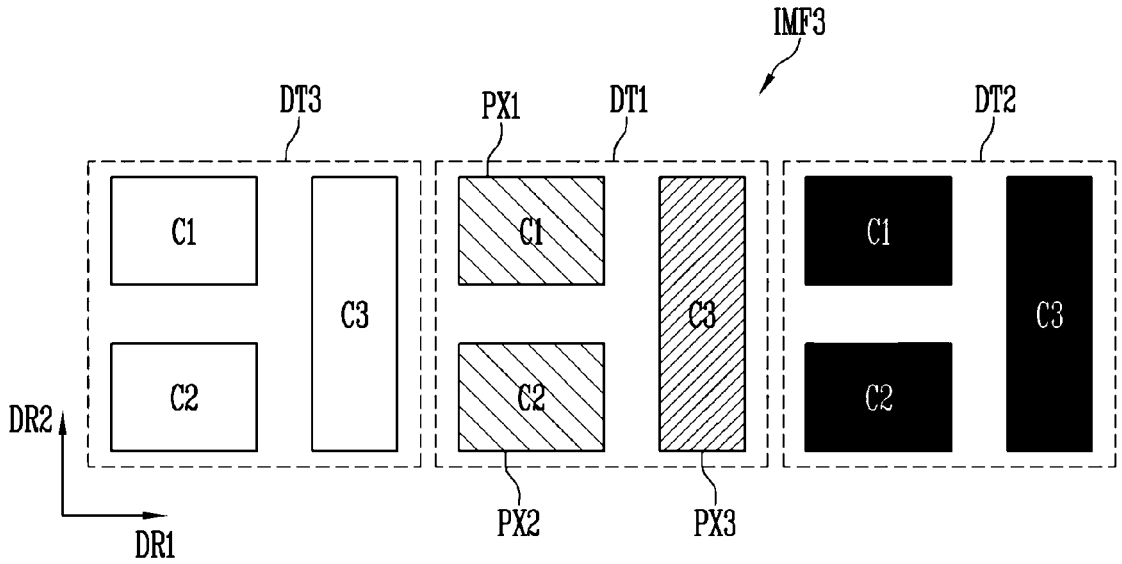
FIG. 12 is a diagram for explaining a third image frame in which a second image frame is corrected by the grayscale correction unit according to an embodiment.

FIG. 11 is a block diagram of a grayscale correction unit 15*a* according to an embodiment. FIG. 12 is a diagram for explaining a third image frame in which the second image frame is corrected by the grayscale correction unit 15*a* of FIG. 11 according to an embodiment.

Referring to FIG. 11, the grayscale correction unit 15*a* of the first embodiment may include a first dot detection unit 110 and a first dot conversion unit 120.

The first dot detection unit 110 may output a first detection signal 1DS when an edge value of the first dot DT1 calculated based on grayscale values G11, G12, G13, G21, G22, G23, G31, G32, and G33 of the first, second, and third dots DT1, DT2, and DT3 is equal to or larger than the threshold value.

It is typically necessary to detect which dots constitute the edge of the character before performing the correction, unless the timing controller 11 receives information on the pixels constituting the character from the processor 9 or other source. However, since the display device 10 cannot discriminate whether the detected dot is the edge of the figure or the edge of the character, unless the display device 10 receives additional information from the processor 9 determination of the edge of the character may be difficult. Hereinafter, a process of detecting the edge of an object by the first dot detection unit 110 will be described.

In the following description, the first dot detection unit 110 may detect whether or not the target dot corresponds to the edge dot in dot units. For example, when there are three pixels constituting the dot, the average value of the grayscale values for the three pixels can be set as the value of the dot. At this time, the grayscale values of each pixel may be multiplied by a weight value according to an embodiment. Hereinafter, for the sake of convenience of explanation, the average value of the grayscale values constituting the dot will be described as the value of the dot by setting the weight value for the grayscale value of each pixel to 1.

According to one embodiment, the first dot detection unit 110 may apply a Prewitt mask of a single row in which the first direction DR1 is the row direction to the first, second, and third dots DT1, DT2, and DT3 to calculate the edge value of the dot DT1. For example, the Prewitt mask of the single row may correspond to Equation 1. In the case of using the Prewitt mask of the single row, the existing line buffer of the timing controller 11 can be used. Therefore, a separate line buffer may be unnecessary, and as such, cost reduction may be possible.

$$[-1\ 0\ 1] \qquad \text{Equation 1}$$

In Equation 1, "0" in the first row and the second column can be multiplied by the value of a discrimination target dot, "−1" in the first row and the first column can be multiplied by the value of the dot adjacent to a direction opposite to the first direction DR1 of the discrimination target dot, and "1" in the first row and the third column can be multiplied by the value of the dot adjacent to the first direction DR1 of the discrimination target dot. The sum of the multiplied values may correspond to the edge value of the discrimination target dot. Here, when the edge value is a negative number, it may mean that the grayscale value falls in the first direction DR1 with the discrimination target dot as a boundary. Also, when the edge value is a positive number, it may mean that the grayscale value rises in the first direction DR1 with the discrimination target dot as a boundary.

For example, referring to FIGS. 8, 9, and 10, a case where the third dot DT3 corresponds to the discrimination target dot will be described. Since grayscale values G31, G32, and G33 of the third dot DT3 are all "255", a value of the third dot DT3 may be "255". A value of the dot adjacent to a direction opposite to the first direction DR1 of the third dot DT3 may be "255". Since the grayscale values G11, G12, and G13 of the first dot DT1 adjacent to the first direction DR1 of the third dot DT3 are "200", "100", and "50", respectively, a value of the first dot DT1 may be "116". For convenience, the fractional part is clipped. Therefore, when Equation 1 is applied with the third dot DT3 as the discrimination target dot, the edge value of the third dot DT3 may become "−139" by the following Equation 2.

$$255*(-1)+255*0+116*1=-139 \qquad \text{Equation 2}$$

For example, referring to FIGS. 8 and 9, a case where the first dot DT1 corresponds to the discrimination target dot will be described. As described above, the value of the first dot DT1 may be "116" and the value of the third dot DT3 may be "255". Since grayscale values G21, G22, and G23 of the second dot DT2 are "0", a value of the second dot DT2 may be "0". Therefore, when Equation 1 is applied with the first dot DT1 as the discrimination target dot, the edge value of the first dot DT1 may become "−255" by the following Equation 3.

$$255*(-1)+116*0+0*1=-255 \qquad \text{Equation 3}$$

For example, referring to FIGS. 8 and 9, a case where the second dot DT2 corresponds to the discrimination target dot will be described. As described above, the value of the second dot DT2 may be "0", the value of the first dot DT1 may be "116", and a value of the dot adjacent to the first direction DR1 of the second dot DT2 may be "116". Therefore, when Equation 1 is applied with the second dot DT2 as the discrimination target dot, the edge value of the second dot DT2 may become "0" by the following Equation 4.

$$116*(-1)+0*0+116*1=0 \qquad \text{Equation 4}$$

According to one embodiment, when the edge value of the discrimination target dot is equal to or greater than the threshold value, the first dot detection unit 110 can determine that the discrimination target dot corresponds to the edge dot, and output the first detection signal DS.

For example, the threshold value can be predetermined as 70% of the maximum value of the dot value. In this case, if the maximum value of the dot value is 255, the threshold value may become 178. Referring to Equations 2, 3, and 4, the absolute value of the edge value of only the first dot DT1 of the dots DT3, DT1, and DT2 may exceed 178. Therefore, the first dot detection unit 110 can output the first detection signal 1DS only for the first dot DT1 of the dots DT3, DT1, and DT2.

The Prewitt mask of a single row may be set as the following Equation 5.

$$[1\ 0\ -1] \qquad \text{Equation 5}$$

The sign of the calculated edge value of the mask of Equation 5 can be reversed to that of the mask of Equation 1.

In another embodiment, the first dot detection unit 110 may calculate the edge value of the discrimination target dot using a Prewitt mask or a Sobel mask of a plurality of rows in which the first direction DR1 is the row direction and the second direction DR2 is the column direction.

For example, the Prewitt mask of the plurality of rows may correspond to Equation 6 or 7.

$$\begin{bmatrix} -1 & 0 & 1 \\ -1 & 0 & 1 \\ -1 & 0 & 1 \end{bmatrix} \qquad \text{Equation 6}$$

$$\begin{bmatrix} 1 & 0 & -1 \\ 1 & 0 & -1 \\ 1 & 0 & -1 \end{bmatrix} \qquad \text{Equation 7}$$

According to Equations 6 and 7, when calculating the edge value of the first dot DT1, three dots in the previous row and three dots in the next row of the first, second, and third dots DT1, DT2, and DT3 may further be considered. The calculation method may be similar to the case of using the Prewitt mask of the single row, and thus, duplicate descriptions thereof will be omitted.

For example, a Sobel mask of a plurality of rows may correspond to Equation 8 or 9.

$$\begin{bmatrix} -1 & 0 & 1 \\ -2 & 0 & 2 \\ -1 & 0 & 1 \end{bmatrix} \quad \text{Equation 8}$$

$$\begin{bmatrix} 1 & 0 & -1 \\ 2 & 0 & -2 \\ 1 & 0 & -1 \end{bmatrix} \quad \text{Equation 9}$$

The calculation method may be similar to the case of using the Prewitt mask of the plurality of rows, and thus, duplicate descriptions thereof will be omitted.

The first dot conversion unit 120 may convert the first grayscale value G11 into a first corrected grayscale value G11' and may convert the second grayscale value G12 into a second corrected grayscale value G12' when the first detection signal 1DS is input.

In one embodiment, the first dot conversion unit 120 may generate the first corrected grayscale value G11' and the second corrected grayscale value G12', which are equal to each other.

For example, the first dot conversion unit 120 may set the average value of the first grayscale value G11 and the second grayscale value G12 as the first corrected grayscale value G11' and the second corrected grayscale value G12'. For instance, when the first grayscale value G11 is "200" and the second grayscale value G12 is "100" in the second image frame IMF2, the first corrected grayscale value G11' for the first pixel PX1 can be set to "150" and the second corrected grayscale value G12' for the second pixel PX2 can be set to "150" in a third image frame IMF3 corrected.

The data driver 12 may supply a first data voltage corresponding to the first corrected grayscale value G11' to the first pixel PX1, a second data voltage corresponding to the second corrected grayscale value G12' to the second pixel PX2, and a third data voltage corresponding to the third grayscale value G13 to the third pixel PX3.

Unlike the second image frame IMF2 described in association with FIG. 10, since the grayscale values in the third image frame IMF3 of FIG. 12 sequentially fall along the first direction DR1, the anti-aliasing effect can be obtained even in the S-stripe structure. For instance, even if the processor 9 provides the second image frame IMF2 for the anti-aliasing font regardless of the structure of the pixel unit 14 of the display device 10, the second image frame IMF2 may be corrected at the display device 10 to generate the third image frame IMF3. As such, the anti-aliasing effect can be obtained.

As another example, the first dot conversion unit 120 may set the first corrected grayscale value G11' and the second corrected grayscale value G12' to a value obtained by adding a value obtained by applying a first weight value wr to the first grayscale value G11 and a value obtained by applying a second weight value wg to the second grayscale value G12.

For example, the first corrected grayscale value G11' and the second corrected grayscale value G12', which are equal to each other, can be calculated by the following Equations 10 and 11.

$$G11' = wr*G11 + wg*G12 \quad \text{Equation 10}$$

$$G12' = wr*G11 + wg*G12 \quad \text{Equation 11}$$

At this time, when the luminance of the first pixel PX1 is lower than the luminance of the second pixel PX2 with respect to the same grayscale value, the first weight value wr may be less than the second weight value wg. Conversely, when the luminance of the first pixel PX1 is higher than the luminance of the second pixel PX2 with respect to the same grayscale value, the first weight value wr may be larger than the second weight value wg. For instance, according to Equations 10 and 11, when setting the first corrected grayscale value G11' and the second corrected grayscale value G12', the grayscale value of a pixel having a low luminance contribution rate can be reflected as a small value and the grayscale value of a pixel having a large luminance contribution rate can be reflected as a large value.

Figure 13:
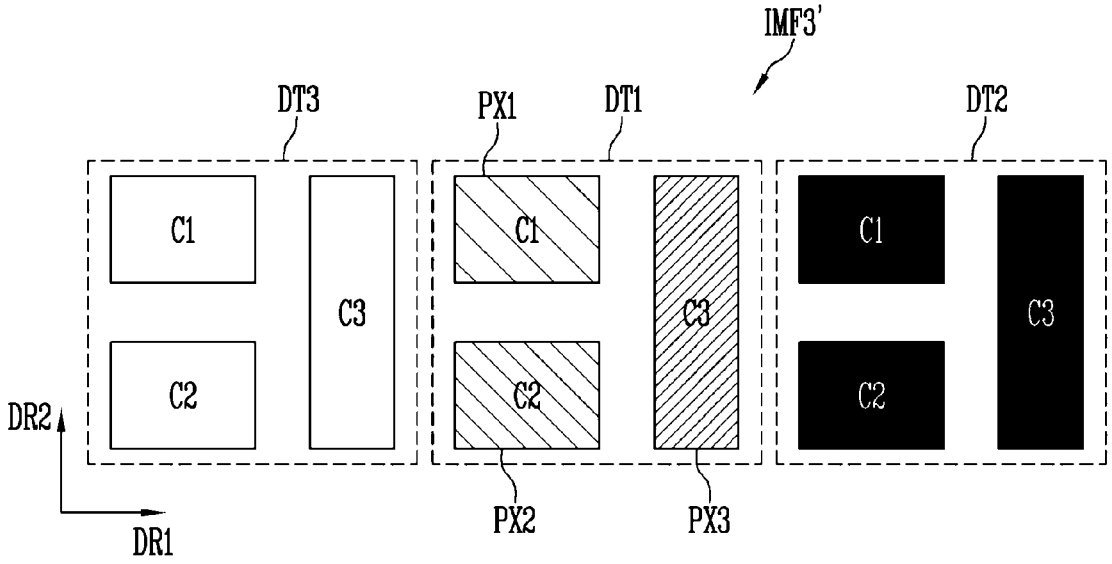
FIG. 13 is a diagram for explaining a third image frame in which a second image frame is corrected by the grayscale correction unit according to an embodiment.

Reference is made to the description of FIG. 13 for the example first and second weight values wr and wg.

FIG. 13 is a diagram for explaining a third image frame IMF3' in which the second image frame is corrected differently by the grayscale correction unit of FIG. 11 according to an embodiment.

When the third image frame IMF3' of FIG. 13 is compared with the third image frame IMF3 of FIG. 12, the first corrected grayscale value G11' and the second corrected grayscale value G12' may be different from each other.

The first dot conversion unit 120 may generate the first corrected grayscale value G11' and the second corrected grayscale value G12' such that the sum of the first grayscale value G11 and the second grayscale value G12 becomes equal to the sum of the first corrected grayscale value G11' and the second corrected grayscale value G12'. At this time, the first corrected grayscale value G11' and the second corrected grayscale value G12' may be different from each other.

For example, when the luminance of the first pixel PX1 is configured to be lower than the luminance of the second pixel PX2 with respect to the same grayscale value, the first corrected grayscale value G11' may be higher than the second corrected grayscale value G12'.

Referring to the ITU-R BT.601 standard, since the degrees of contribution of red, green, and blue to the luminance are different from each other despite the same grayscale value, the following Equation 12 may be established.

$$Y = wr*R + wg*G + wb*B, \text{ where } wr=0.299,\ wg=0.587,\ wb=0.114 \quad \text{Equation 12}$$

Here, Y is the luminance, R is the grayscale value of the red pixel, G is the grayscale value of the green pixel, B is the grayscale value of the blue pixel, and wr, wg and wb are the weight values of the respective colors. As such, with respect to the same grayscale value, the green pixel may be the brightest and the blue pixel may be the darkest.

Therefore, when the first pixel PX1 is the red pixel and the second pixel PX2 is the green pixel, the luminance of the first pixel PX1 may be lower than the luminance of the second pixel PX2 with respect to the same grayscale value. In this case, by making the first corrected grayscale value G11' higher than the second corrected grayscale value G12', the luminance level of the first pixel PX1 and the luminance level of the second pixel PX2 can be substantially equalized.

On the other hand, when the luminance of the second pixel PX2 is configured to be lower than the luminance of the first pixel PX1 with respect to the same grayscale value, the second corrected grayscale value G12' can be greater than the first corrected grayscale value G11'.

Therefore, when the first pixel PX1 is the green pixel and the second pixel PX2 is the red pixel, the luminance of the second pixel PX2 may be lower than the luminance of the first pixel PX1 with respect to the same grayscale value. In this case, by making the second corrected grayscale value G12' greater than the first corrected grayscale value G11', the luminance level of the first pixel PX1 and the luminance level of the second pixel PX2 can be substantially equalized.

In another embodiment, the first dot conversion unit 120 may calculate a first final corrected grayscale value G11_f and a second final corrected grayscale value G12_f as shown in following Equations 13 and 14 using the first corrected grayscale value G11' and the second corrected grayscale value G12' obtained by Equations 10 and 11.

$$G11_f = G11'/(wr*2) \quad \text{Equation 13}$$

$$G12_f = G12'/(wg*2) \quad \text{Equation 14}$$

According to Equations 13 and 14, when the luminance of the first pixel PX1 is configured to be lower than the luminance of the second pixel PX2 with respect to the same grayscale value, the first final corrected grayscale value G11_f can be greater than the second final corrected grayscale value G12_f On the other hand, when the luminance of the second pixel PX2 is configured to be lower than the luminance of the first pixel PX1 with respect to the same grayscale value, the second final corrected grayscale value G12_f can be greater than the first final corrected grayscale value G11_f.

Figure 14:
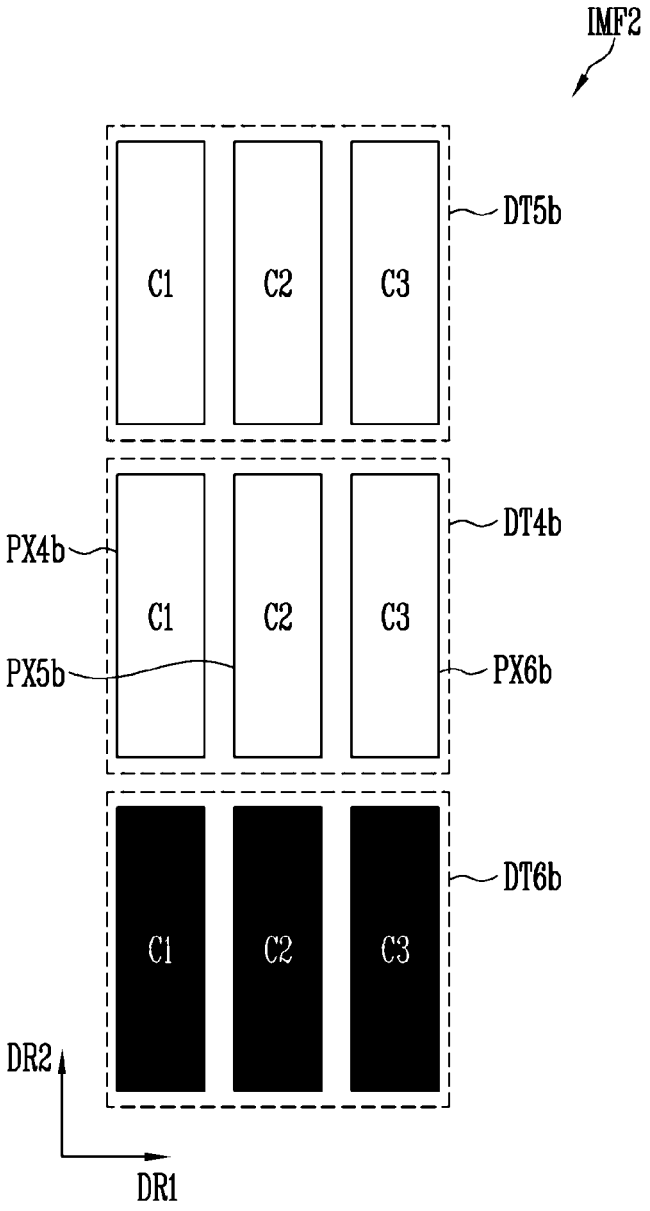
FIG. 14 is an enlarged view of the fourth to sixth dots of FIG. 8 according to an embodiment.

FIG. 14 is an enlarged view of the fourth to sixth dots of FIG. 8 according to an embodiment.

Referring to FIGS. 8 and 14, the fifth dot DT5b may be adjacent to the fourth dot DT4b in the second direction DR2. The sixth dot DT6b may be adjacent to the fourth dot DT4b in the direction opposite to the second direction DR2.

In the second image frame IMF2, the fifth dot DT5b and the fourth dot DT4b may display a white color, which does not constitute a character, and the sixth dot DT6b may display a black color, which constitutes the character. The grayscale values of the pixels of the fifth dot DT5b may all be "255", and thus, the value of the fifth dot DT5b may be "255". The grayscale values of the fourth pixel DT4b, the fifth pixel DT5b, and the sixth pixel DT6b of the fourth dot DT4b may all be "255", and thus, the value of the fourth dot DT4b may be "255". The grayscale values of the pixels of the sixth dot DT6b may all be "0", and thus, the value of the sixth dot DT6b may be "0".

In the second image frame IMF2, the fourth dot DT4b may be adjacent to the sixth dot DT6b corresponding to the edge of the character. Since the pixels PX4, PX5, and PX6 of the fourth dot DT4b are adjacent to the sixth dot DT6b in the second direction DR2 at the same or similar rate with respect to the first direction DR1, there is no particular problem in displaying the second image frame IMF2 in the RGB-stripe structure.

Figure 15:
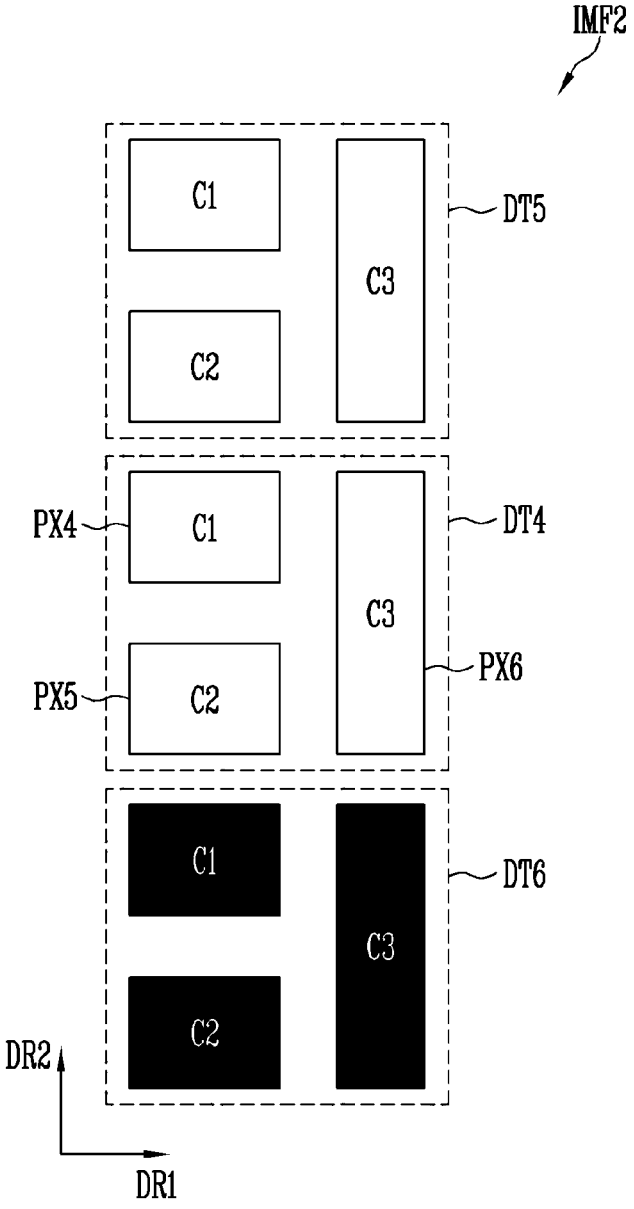
FIG. 15 is a diagram for explaining a case where a second image frame is displayed without correction in the S-stripe structure according to an embodiment.

FIG. 15 is a diagram for explaining a case where a second image frame is displayed without correction in the S-stripe structure according to an embodiment.

A case where the second image frame IMF2 is displayed in the pixel unit 14 of the display device 10 described in association with FIG. 1 will be described with reference to FIG. 15.

In the pixel unit 14, the fifth dot DT5 may be adjacent to the fourth dot DT4 in the second direction DR2 and the sixth dot DT6 may be adjacent to the fourth dot DT4 in the direction opposite to the second direction DR2.

The fourth dot DT4 may include the fourth pixel PX4, the fifth pixel PX5, and the sixth pixel PX6. The sixth pixel PX6 may be located in the first direction DR1 from the fourth pixel PX4 and the fifth pixel PX6. The fourth pixel PX4 may be located in the second direction DR2 from the fifth pixel PX5.

In the second image frame IMF2, the fifth dot DT5 and the fourth dot DT4 may display a white color, which does not constitute a character, and the sixth dot DT6 may display a black color, which constitutes the character. The grayscale values of the pixels of the fifth dot DT5 may all be "255", and thus, the value of the fifth dot DT5 may be "255". The grayscale values of the fourth pixel PX4, the fifth pixel PX5, and the sixth pixel PX6 of the fourth dot DT4 may all be "255", and thus, the value of the fourth dot DT4 may be "255". The grayscale values of the pixels of the sixth dot DT6 may all be "0", and thus, the value of the sixth dot DT6 may be "0".

Unlike the case described in association with FIG. 14, the distance between the fourth pixel PX4 and the sixth dot DT6 and the distance between the fifth pixel PX5 and the sixth dot DT6 may be different from each other. For instance, the distance between the fifth pixel PX5 and the sixth dot DT6 may be shorter than the distance between the fourth pixel PX4 and the sixth dot DT6. Therefore, the user may view a stripe pattern in which the second color C2 of the fifth pixel PX5 extends in the first direction DR1 from the upper edge of the character (color fringing problem).

On the other hand, referring to FIG. 8, in the fourth dot of the pixel unit 14 corresponding to the fourth dot DT4b', the distance between the fourth pixel and the sixth dot may be shorter than the distance between the fifth pixel and the sixth dot. Therefore, the user may view a stripe pattern in which the first color C1 of the fourth pixel extends in the first direction DR1 from the lower edge of the character.

Figure 16:
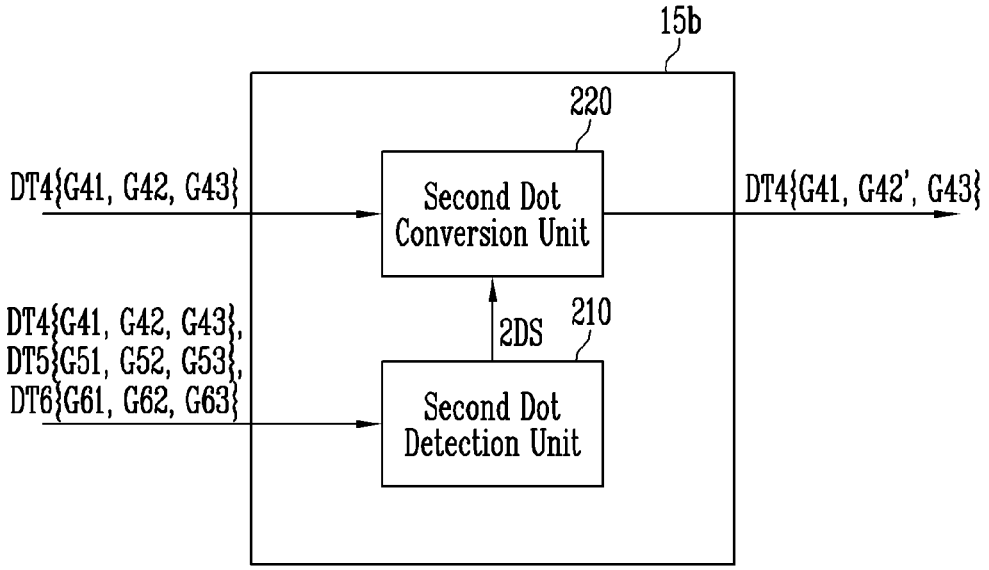
FIG. 16 is a block diagram of a grayscale correction unit according to an embodiment.
Figure 17:
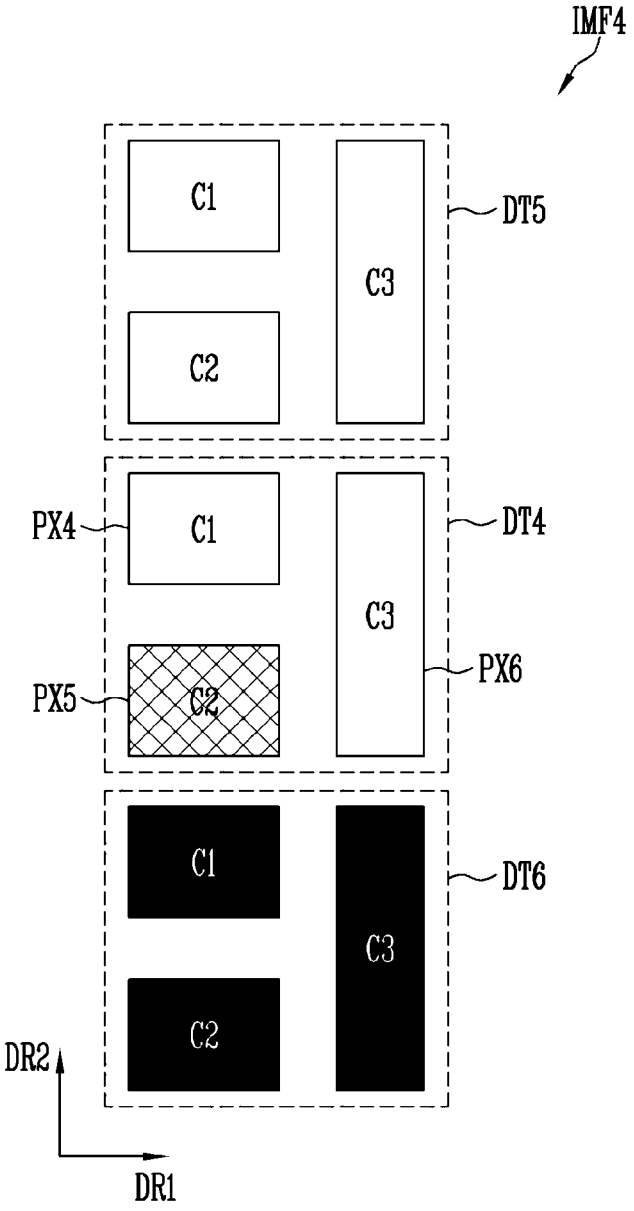
FIG. 17 is a diagram for explaining a fourth image frame in which the second image frame is corrected by the grayscale correction unit of FIG. 16 according to an embodiment.

FIG. 16 is a block diagram of a grayscale correction unit 15b according to an embodiment. FIG. 17 is a diagram for explaining a fourth image frame IMF4 in which the second image frame is corrected by the grayscale correction unit 15b of FIG. 16 according to an embodiment.

Referring to FIG. 16, the grayscale correction unit 15b may include a second dot detection unit 210 and a second dot conversion unit 220.

The second dot detection unit 210 may output a second detection signal 2DS based on grayscale values G41, G42, G43, G51, G52, G53, G61, G62, and G63 of the fourth, fifth, and sixth dots DT4, DT5, and DT6 when the fourth dot DT4 is determined as a dot adjacent to the edge of the object included in the second image frame IMF2.

For example, the second dot detection unit 210 may output the second detection signal 2DS based on the grayscale values G41, G42, G43, G51, G52, G53, G61, G62, and G63 of the fourth, fifth, and sixth dots DT4, DT5, and DT6 when an edge value of the fourth dot DT4 is equal to or greater than the threshold value.

According to one embodiment, the second dot detection unit 210 may calculate the edge value of the fourth dot DT4 by applying a Prewitt mask of a single column in which the second direction DR2 is the column direction to the fourth, fifth, and sixth dots DT4, DT5, and DT6. For example, the Prewitt mask of the single column may correspond to the following Equation 15.

$$\begin{bmatrix} 1 \\ 0 \\ -1 \end{bmatrix} \quad \text{Equation 15}$$

In Equation 15, "0" in the second row and the first column can be multiplied by the value of the discrimination target dot, "1" in the first row and the first column can be multiplied by the value of the dot adjacent to the discrimination target dot in the second direction DR2, and "−1" in the third row and the first column can be multiplied by the value of a dot adjacent to the direction opposite to the second direction DR2 of the discrimination target dot. The sum of the multiplied values may correspond to the edge value of the discrimination target dot. Here, when the edge value is a negative number, it may mean that the grayscale value falls in the second direction DR2 with the discrimination target dot as a boundary. Also, when the edge value is a positive number, it may mean that the grayscale value rises in the second direction DR2 with the discrimination target dot as a boundary.

For example, a case where the fifth dot DT5 corresponds to the discrimination target dot will be described referring to FIGS. 8, 14, and 15. A value of the fifth dot DT5 may be "255", a value of a dot located in the second direction DR2 of the fifth dot DT5 may be "255", and a value of the fourth dot DT4 may be "255". Therefore, when the fifth dot DT5 as the discrimination target dot is applied to Equation 15, the edge value of the fifth dot DT5 may become "0".

For example, a case where the fourth dot DT4 corresponds to the discrimination target dot will be described referring to FIGS. 8, 14, and 15. The value of the fourth dot DT4 may be "255", the value of the fifth dot DT5 may be "255", and the value of the sixth dot DT6 may be "0". Therefore, when Equation 15 is applied with the fourth dot DT4 as the discrimination target dot, the edge value of the fourth dot DT4 may become "255".

In addition, for example, a case where the sixth dot DT6 corresponds to the discrimination target dot will be described referring to FIGS. 8, 14, and 15. The value of the sixth dot DT6 may be "0", the value of the fourth dot DT4 may be "255", and a value of a dot adjacent to the sixth dot DT6 in the direction opposite to the second direction DR2 may be "255". Therefore, when the sixth dot DT6 as the discrimination target dot is applied to Equation 15, the edge value of the sixth dot DT6 may become "0".

According to one embodiment, the second dot detection unit 210 may output the second detection signal 2DS by discriminating that the discrimination target dot corresponds to the dot adjacent to the edge of the object when the edge value of the discrimination target dot is equal to or greater than the threshold value.

For example, the threshold value can be predetermined as 70% of the maximum value of the dot value. In this case, if the maximum value of the dot value is 255, the threshold value may become 178. Only the fourth dot DT4 among the dots DT4, DT5 and DT6 may have an absolute value of the edge value exceeding 178. Therefore, the second dot detection unit 210 may output the second detection signal 2DS only to the fourth dot DT4 among the dots DT4, DT5, and DT6.

According to one embodiment, the second detection signal 2DS may include the sign of the edge value as information.

The mask of Equation 15 can be modified as in Equations 5, 6, 7, 8, and 9. Duplicate descriptions are omitted.

When the second detection signal 2DS is input, the second dot conversion unit 220 may select one of the fourth grayscale value G41 corresponding to the fourth pixel PX4 and the fifth grayscale value G42 corresponding to the fifth pixel PX5 based on the second detection signal 2DS and may generate a third corrected grayscale value by decreasing a selected grayscale value.

As described above, the second detection signal 2DS may include the sign of the edge value as information. For example, when the mask of Equation 15 is used as described above, when the edge value is a negative number, it may mean that the grayscale value falls in the second direction DR2 with the discrimination target dot as a boundary. In addition, when the edge value is a positive number, it may mean that the grayscale value rises in the second direction DR2 with the discrimination target dot as a boundary.

The edge value of the fourth dot DT4 described above may be "255", which is a positive number. Accordingly, the second dot conversion unit 220 can recognize that the boundary area between the fourth dot DT4 and the sixth dot DT6 is the edge of the object based on the second detection signal 2DS. In this case, the second dot conversion unit 220 may select the fifth grayscale value G42 corresponding to the fifth pixel PX5 and may generate a third corrected grayscale value G42' by decreasing the fifth grayscale value G42. When the second dot conversion unit 220 generates the third corrected grayscale value G42' by decreasing the fifth grayscale value G42, the data driver 12 may supply a data voltage corresponding to the third corrected grayscale value G42' to the fifth pixel PX5.

For example, the third corrected grayscale value G42' may be obtained by decreasing the selected fifth grayscale value G42 by 20%. The amount of decrease can be specified differently according to the specification of the display device 10.

Comparing the case where the second image frame IMF2 of FIG. 15 is applied to the pixel unit 14 and the case where the fourth image frame IMF4 of FIG. 17 is applied to the pixel unit 14, it can be confirmed that the color fringing problem by the fifth pixel PX5 in the S-strip structure can be alleviated.

Referring to the dots DT4*b*', DT5*b*', and DT6*b*' in FIG. 8, the second dot detection unit 210 may output the second detection signal 2DS having information that the edge value is a negative number for the fourth to sixth dots when the discrimination target dot is the fourth dot. Therefore, the second dot conversion unit 220 can recognize that the boundary area between the fourth dot and the fifth dot is the edge of the object based on the second detection signal 2DS. In this case, the second dot conversion unit 220 may select the fourth grayscale value corresponding to the fourth pixel and may generate the third corrected grayscale value by decreasing the fourth grayscale value. When the second dot conversion unit 220 generates the third corrected grayscale value by decreasing the fourth grayscale value, the data driver 12 may supply the data voltage corresponding to the third corrected grayscale value to the fourth pixel.

Figure 18:
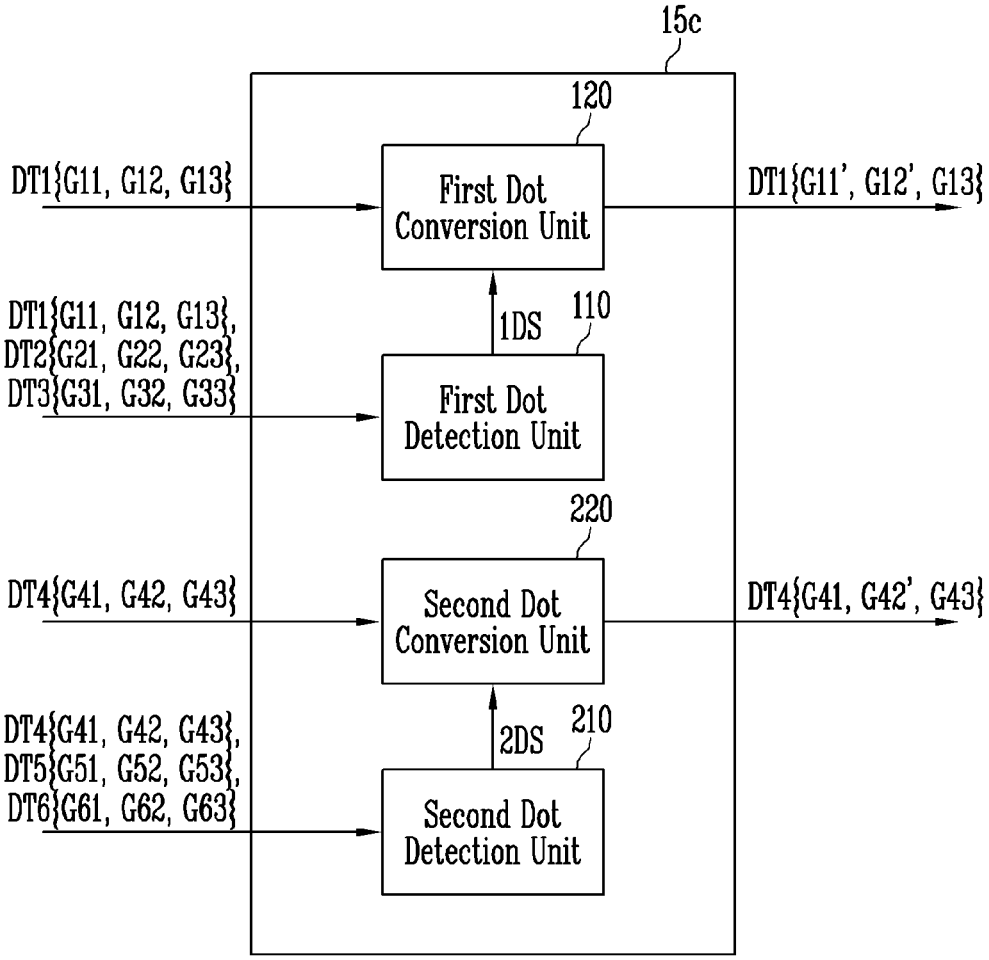
FIG. 18 is a block diagram of a grayscale correction unit according to an embodiment.

FIG. 18 is a block diagram for explaining a grayscale correction unit 15*c* according to an embodiment.

The grayscale correction unit 15*c* in FIG. 18 may include the grayscale correction unit 15*a* in FIG. 11 and the grayscale correction unit 15*b* in FIG. 16.

In this case, it may be a problem whether the correction by the first dot detection unit 110 and the first dot conversion unit 120 or the correction by the second dot detection unit 210 and the second dot conversion unit 220 is initially performed for the second image frame IMF2.

Referring to FIGS. 7 and 8, when the processor 9 constructs the second image frame IMF2 using the anti-aliasing font, a sequential change of the grayscale values in the first direction DR1 can be confirmed.

According to one embodiment, the correction by the first dot detection unit 110 and the first dot conversion unit 120 may be initially performed so that the correction in the first direction DR1, which is the main direction, can be initially performed. The first direction DR1 may be a direction in which characters are arranged in a sentence.

In another embodiment, however, when resolution of the color fringing problem is more important than resolution of the aliasing problem, the correction by the second dot detection unit 210 and the second dot conversion unit 220 may be initially performed.

Figure 19:
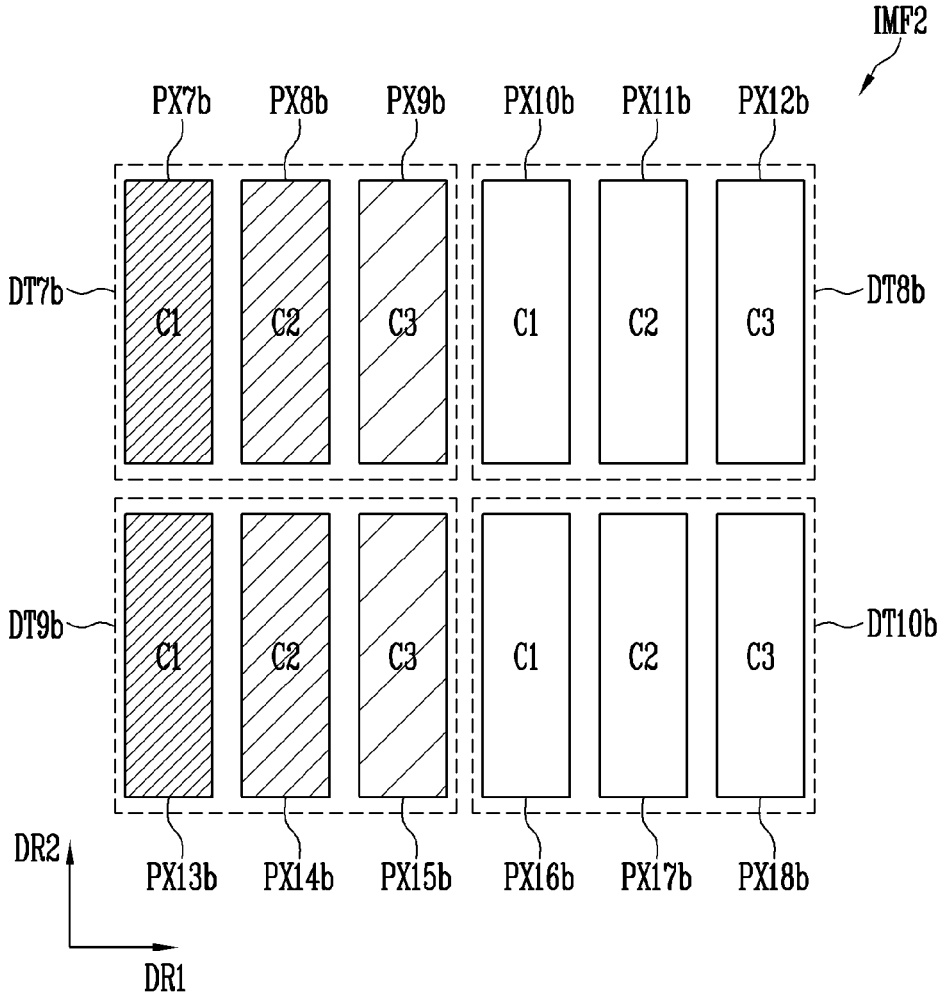
FIG. 19 is an enlarged view of the seventh to tenth dots of FIG. 8 according to an embodiment.

FIG. 19 is an enlarged view of the seventh to tenth dots of FIG. 8 according to an embodiment.

The seventh dot DT7*b* may include a seventh pixel PX7*b*, an eighth pixel PX8*b*, and a ninth pixel PX9*b*. For example, the processor 9 may provide a grayscale value of "50" to the seventh pixel PX7*b*, a grayscale value of "100" to the eighth pixel PX8*b*, and a grayscale value of "200" to the ninth pixel PX9*b* in the second image frame IMF2.

The eighth dot DT8*b* may be adjacent to the seventh dot DT7*b* in the first direction DR1 and may include a tenth pixel PX10*b*, an eleventh pixel PX11*b*, and a twelfth pixel PX12*b*. For example, the processor 9 may provide grayscale values of "255" to the tenth pixel PX10*b*, the eleventh pixel PX11*b*, and the twelfth pixel PX12*b* in the second image frame IMF2.

A ninth dot DT9*b* may be adjacent to the seventh dot DT7*b* in the direction opposite to the second direction DR2 and may include a thirteenth pixel PX13*b*, a fourteenth pixel PX14*b*, a fifteenth pixel PX15*b*. For example, the processor 9 may provide a grayscale value of "50" to the thirteenth pixel PX13*b*, a grayscale value of "100" to the fourteenth pixel PX14*b*, and a grayscale value of "200" to the fifteenth pixel PX15*b* in the second image frame IMF2.

The tenth dot DT10*b* may be adjacent to the ninth dot DT9*b* in the first direction DR1 and may include a sixteenth pixel PX16*b*, a seventeenth pixel PX17*b*, and an eighteenth pixel PX18*b*. For example, the processor 9 may provide the grayscale values of "255" to the sixteenth pixel PX16*b*, the seventeenth pixel PX17*b*, and the eighteenth pixel PX18*b* in the second image frame IMF2.

In the RGB-stripe structure of FIG. 19, the luminance change may sequentially occur in the first direction DR1 and the luminance may be maintained constantly in the second direction DR2, so that the anti-aliasing effect can be exhibited.

Figure 20:
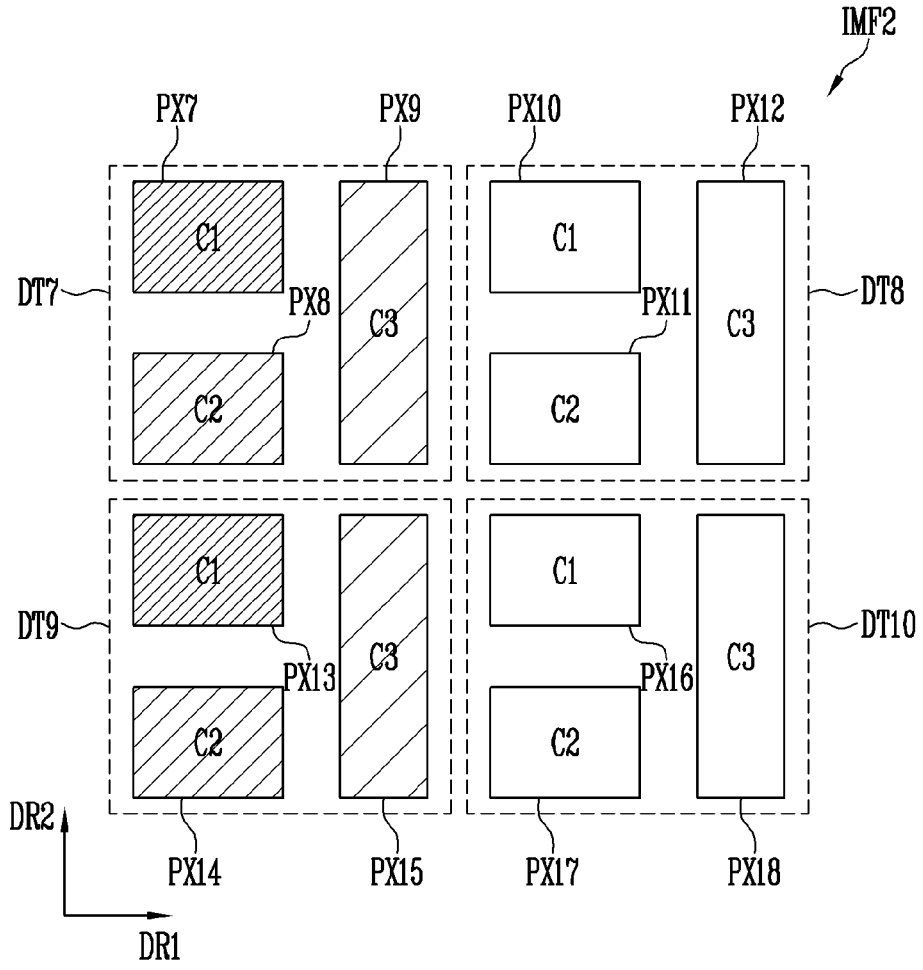
FIG. 20 is a diagram for explaining a case where a second image frame is displayed without correction in the S-stripe structure according to an embodiment.

FIG. 20 is a diagram for explaining a case where the second image frame is displayed without correction in the S-stripe structure according to an embodiment.

The seventh dot DT7 may include the seventh pixel PX7, the eighth pixel PX8, and the ninth pixel PX9. The ninth pixel PX9 may be located in the first direction DR1 from the seventh pixel PX7 and the eighth pixel PX8, and the seventh pixel PX7 may be located in the second direction DR2 from the eighth pixel PX8.

The eighth dot DT8 may be adjacent to the seventh dot DT7 in the first direction DR1 and may include the tenth pixel PX10, the eleventh pixel PX11, and the twelfth pixel PX12. The twelfth pixel PX12 may be located in the first direction DR1 from the tenth pixel PX10 and the eleventh pixel PX11, and the tenth pixel PX10 may be located in the second direction DR2 from the eleventh pixel PX11.

The ninth dot DT9 may be adjacent to the seventh dot DT7 in the direction opposite to the second direction DR2 and may include the thirteenth pixel PX13, the fourteenth pixel PX14, and the fifteenth pixel PX15. The fifteenth pixel PX15 may be located in the first direction DR1 from the thirteenth pixel PX13 and the fourteenth pixel PX14, and the thirteenth pixel PX13 may be located in the second direction DR2 from the fourteenth pixel PX14.

The tenth dot DT10 may be adjacent to the ninth dot DT9 in the first direction DR1 and may include the sixteenth pixel PX16, the seventeenth pixel PX17, and the eighteenth pixel PX18. The eighteenth pixel PX18 may be located in the first direction DR1 from the sixteenth pixel PX16 and the seventeenth pixel PX17, and the sixteenth pixel PX16 may be located in the second direction DR2 from the seventeenth pixel PX17.

In the S-stripe structure of FIG. 20, when the grayscale values of the second image frame IMF2 are applied without correction, the luminance may change irregularly in the first direction DR1 and/or the second direction DR2 so that the anti-aliasing effect cannot work properly.

In addition, in the eighth pixel PX8 and the fourteenth pixel PX14 in which the grayscale values of "100" are provided as compared with the seventh pixel PX7 and the fourteenth pixel PX13 in which the grayscale values of "50" are provided, the color fringing phenomenon for the second color C2 may occur. This color fringing phenomenon may occur more strongly when the luminance of the second color C2 is higher than the luminance of the first color C1 for the same grayscale value. For example, the second color C2 may be green and the first color C1 may be red.

Figure 21:
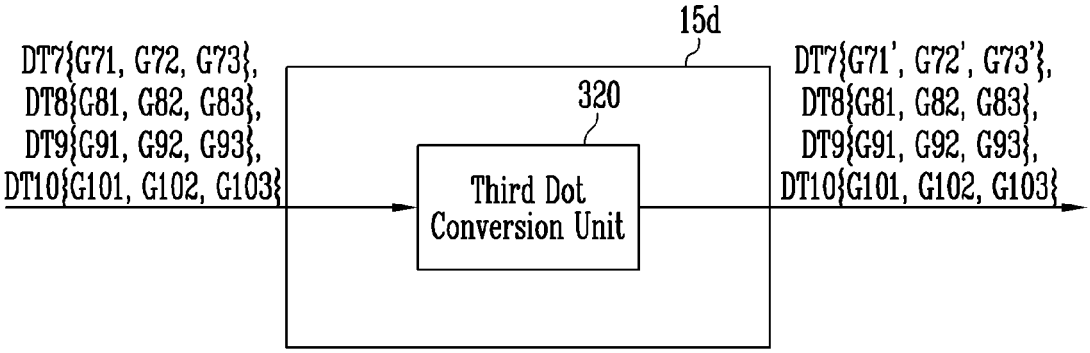
FIG. 21 is a block diagram of a grayscale correction unit according to an embodiment.
Figure 22:
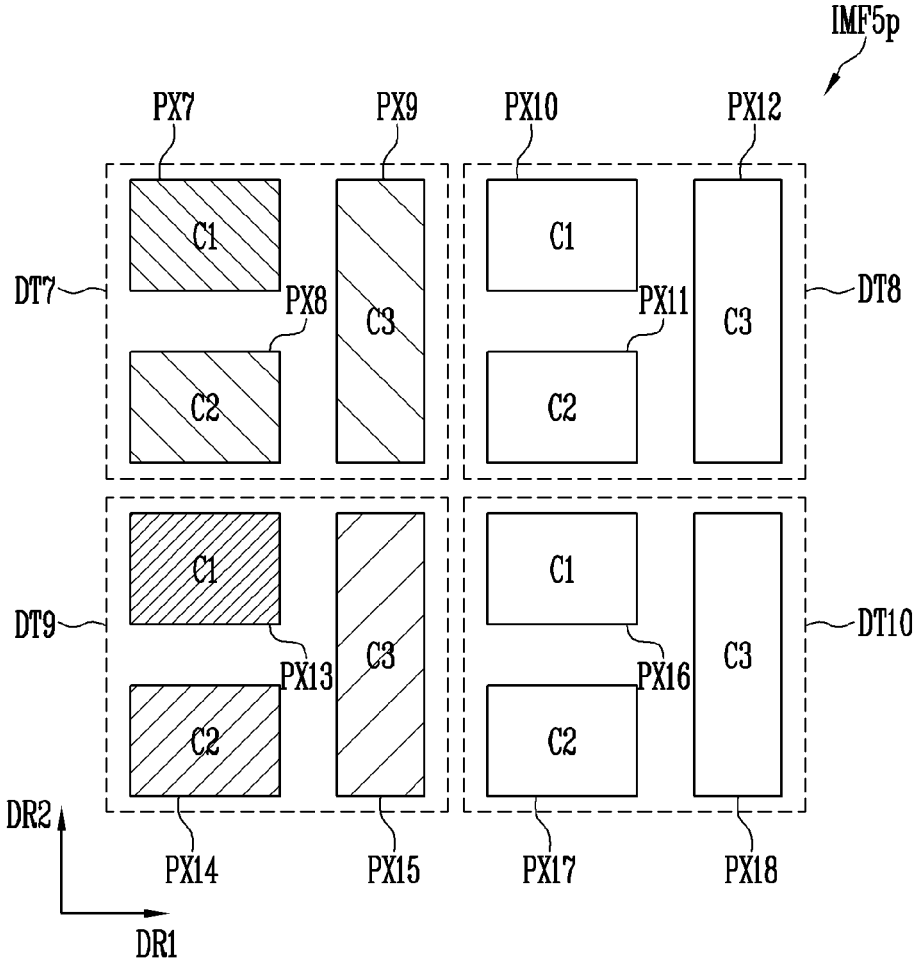
FIG. 22 is a diagram for explaining a fifth image frame in which the second image frame is partially corrected by the grayscale correction unit of FIG. 21 according to an embodiment.

FIG. 21 is a block diagram of a grayscale correction unit 15*d* according to an embodiment. FIG. 22 is a diagram for explaining a fifth image frame IMF5 in which the second image frame is partially corrected by the grayscale correction unit of FIG. 21 according to an embodiment.

Referring to FIG. 21, the grayscale correction unit 15*d* may include a third dot conversion unit 320. The grayscale correction unit 15*d* and the third dot conversion unit 320 may refer to the same components.

Unlike the other embodiments, the grayscale correction unit 15*d* may not include a separate dot detection unit. For example, the grayscale correction unit 15*d* may perform grayscale correction on all the dots without the process for detecting the edge dot. However, the grayscale correction may not be applied to some outermost dots to which the following Equations cannot be applied.

The grayscale correction unit 15*d* may generate corrected grayscale values G71', G72', and G73' for colors C1, C2, and C3, respectively, of the seventh dot DT7 based on grayscale values G71, G72, G73, G81, G82, G83, G91, G92, G93, G101, G102, and G103 for the same colors of the eighth, ninth, and tenth dots DT8, DT9, and DT10.

The grayscale correction unit 15*d* may generate a fourth corrected grayscale value G71' for the first color C1 based on the grayscale values G71, G81, G91, and G101 of the seventh pixel PX7, the tenth pixel PX10, the thirteenth pixel PX13, and the sixteenth pixel PX16.

The grayscale correction unit 15*d* may generate a fifth corrected grayscale value G72' for the second color C2 based on the grayscale values G72, G82, G92, and G102 of the eighth pixel PX8, the eleventh pixel PX11, the fourteenth pixel PX14, and the seventeenth pixel PX17. In addition, the grayscale correction unit 15*d* may generate a sixth corrected grayscale value G73' for the third color C3 based on the grayscale values G73, G83, G93, and G103 of the ninth pixel PX9, the twelfth pixel PX12, the fifteenth pixel PX15, and the eighteenth pixel PX18.

The data driver 12 may supply the data voltage corresponding to the fourth corrected grayscale value G71' to the seventh pixel PX7, the data voltage corresponding to the fifth corrected grayscale value G72' to the eighth pixel PX8, and the data voltage corresponding to the sixth corrected grayscale value G73' to the ninth pixel PX9.

For example, the grayscale correction unit 15*d* may generate the fourth, fifth, and sixth corrected grayscale values G71', G72', and G73' for the seventh dot DT7 based on the following Equation 16.

$$\begin{bmatrix} F1 & F2 \\ F3 & F4 \end{bmatrix} \quad \text{Equation 16}$$

Here, F1 is a weight value to be multiplied by each of the pixels PX7, PX8, and PX9 of the seventh dot DT7, F2 is a weight value to be multiplied by each of the pixels PX10, PX11, and PX12 of the eighth dot DT8, F3 is a weight value to be multiplied by each of the pixels PX13, PX14, and PX15 of the ninth dot DT9, and F4 is a weight value to be multiplied by each of the pixels PX16, PX17, and PX18 of the tenth dot DT10.

According to one embodiment, in Equation 16, the magnitude of F1 may be greater than those of F2, F3, and F4. For example, the self-grayscale ratio may be relatively large. Therefore, F1 (which is the weight value for the grayscale value G71 of the seventh pixel PX7) may be the largest in generating the fourth corrected grayscale value G71', F1 (which is the weight value for the grayscale value G72 of the eighth pixel PX8) may be the largest in generating the fifth corrected grayscale value G72', and F1 (which is the weight value for the grayscale value G73 of the ninth pixel PX9) may be the largest in generating the sixth corrected grayscale value G73'.

According to one embodiment, the value obtained by adding F1, F2, F3, and F4 in Equation 16 may be 1. At this time, F1, F2, F3, and F4 can be variably adjusted to about 20% depending on the product. For example, F1 may be set to 0.625, F2 may be set to 0.125, F3 may be set to 0.125, and F4 may be set to 0.125. In addition, F1 may be a value in a range from 0.5 to 0.75, F2 may be a value in a range from 0.1 to 0.15, F3 may be a value in a range from 0.1 to 0.15, and F4 may be a value in a range from 0.1 to 0.15, depending on the product.

Those skilled in the art will be able to determine the values of F1, F2, F3, and F4 that are appropriate for the product by appropriately adjusting the example values.

For example, the fourth corrected grayscale value G71' may be calculated as shown in the following Equation 17.

$$0.625*50+0.125*255+0.125*50+0.125*255=101.25 \quad \text{Equation 17}$$

Here, when digits after the decimal point are discarded, the fourth corrected grayscale value G71' may be "101".

For example, the fifth corrected grayscale value G72' may be calculated as shown in the following Equation 18.

$$0.625*100+0.125*255+0.125*100+0.125*255=138.75 \quad \text{Equation 18}$$

Here, when digits after the decimal point are discarded, the fifth corrected grayscale value G72' may be "138".

For example, the sixth corrected grayscale value G73' can be calculated as shown in the following Equation 19.

$$0.625*200+0.125*255+0.125*200+0.125*255=213.75 \quad \text{Equation 19}$$

Here, when digits after the decimal point are discarded, the sixth corrected grayscale value G73' may be "213".

It can be seen that the calculated fourth, fifth, and sixth corrected grayscale values G71', G72', and G73' have a smaller difference than the pre-corrected grayscale values G71, G72, and G73. Therefore, the color fringing problem that occurs in FIG. 20 can be mitigated.

In addition, it can be seen that the calculated fourth, fifth, and sixth corrected grayscale values G71', G72', and G73' are corrected in the high grayscale direction as compared with the pre-corrected grayscale values G71, G72, and G73. Since the human eyes are less sensitive to the change in the high grayscale than the change in the low grayscale, the color fringing problem that occurs in FIG. 20 can be further mitigated.

FIG. 22 shows a fifth partial image frame IMF5*p* to which the corrected grayscale values G71', G72', and G73' are applied to the seventh dot DT7, which is a part of the second image frame IMF2. The same process as described above can be performed by the grayscale correction unit 15*d* for the other dots DT8, DT9, and DT10. The data processed by the grayscale correction unit 15*d* may depend on the data of the second image frame IMF2 provided by the processor 9 and may be independent of the data of the fifth partial image frame IMF5*p* already processed.

According to one embodiment, the grayscale correction unit 15*d* may set F3 and F4 in Equation 16 to 0 in order to perform correction on the first direction DR1. For example, F1=0.75, F2=0.25, F3=0, and F4=0 may be satisfied.

According to another embodiment, the grayscale correction unit 15*d* may set F2 and F4 in Equation 16 to 0 in order to perform correction on the second direction DR2. For example, F1=0.75, F2=0, F3=0.25, and F4=0 may be satisfied.

Figure 23:
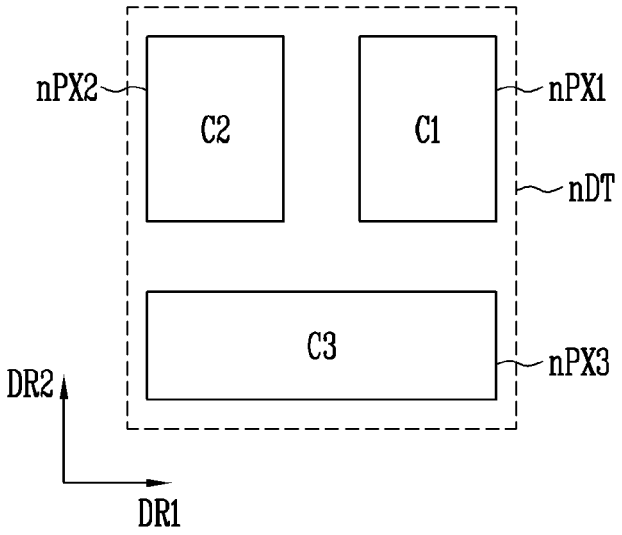
FIG. 23 is a diagram for explaining a case where embodiments are applied to the S-stripe structure which is different from those shown in FIGS. 1 and 4.

FIG. 23 is a diagram for explaining a case where embodiments are applied to the S-stripe structure which is different from FIGS. 1 and 4.

Referring to FIG. 23, a first dot nDT may include a first pixel nPX1, a second pixel nPX2, and a third pixel nPX3. The first pixel nPX1 may be located in the first direction DR1 from the second pixel nPX2 and the first pixel nPX1 and the second pixel nPX2 may be located in the second direction DR2 from the third pixel nPX3.

For instance, the first dot nDT of FIG. 23 may be tilted by 90 degrees with respect to the first dot DT1 of FIG. 1.

The case of the embodiment described in association with FIG. 23 may also include the second dot adjacent to the first dot nDT in the first direction DR1 and the third dot adjacent to the first dot nDT in the direction opposite to the first direction DR1.

All the embodiments that can be applied to the first dot DT1 of FIG. 1 can be applied to the first dot nDT of FIG. 23.

For example, when the first dot nDT is determined as the edge of the object included in the image frame based on the grayscale values of the first to third dots, the grayscale correction unit may generate the first corrected grayscale value and the second corrected grayscale value based on the first grayscale value corresponding to the first pixel nPX1 and the second grayscale value corresponding to the second pixel nPX2.

The grayscale correction unit may include a first dot detection unit for outputting a first detection signal when the edge value of the first dot nDT calculated based on the grayscale values of the first to third dots is equal to or greater than a threshold value.

In addition, the grayscale correction unit may include a first dot conversion unit. The first dot conversion unit may convert the first grayscale value into the first corrected grayscale value and may convert the second grayscale value into the second corrected grayscale value when the first detection signal is input. The first corrected grayscale value and the second corrected grayscale value may be equal to each other.

On the other hand, the grayscale correction unit may include a first dot conversion unit. The first dot conversion unit may convert the first grayscale value into the first corrected grayscale value and may convert the second grayscale value into the second corrected grayscale value when the first detection signal is input. The sum of the first grayscale value and the second grayscale value may be equal to the sum of the first corrected grayscale value and the second corrected grayscale value.

The case of the embodiment described in association with FIG. 23 may include the fifth dot adjacent to the fourth dot in the second direction DR2 and the sixth dot adjacent to the fourth dot in the direction opposite to the second direction DR2. The fourth dot may include the fourth pixel, the fifth pixel, and the sixth pixel. The sixth pixel may be located in the first direction DR1 from the fourth pixel and the fifth pixel and the fourth pixel may be located in the second direction DR2 from the fifth pixel.

The grayscale correction unit may include a second dot detection unit for outputting the second detection signal when the fourth dot is determined as a dot adjacent to the edge of the object included in the image frame based on the grayscale values for the fourth to sixth dots.

In addition, the grayscale correction unit may include a second dot conversion unit for generating the third corrected grayscale value. The second dot conversion unit may select one of the fourth grayscale value corresponding to the fourth pixel and the fifth grayscale value corresponding to the fifth pixel based on the second detection signal when the second detection signal is input and may generate the third corrected grayscale value by decreasing the selected grayscale value.

At this time, the first corrected grayscale value and the second corrected grayscale value may be equal to each other.

Figure 24:
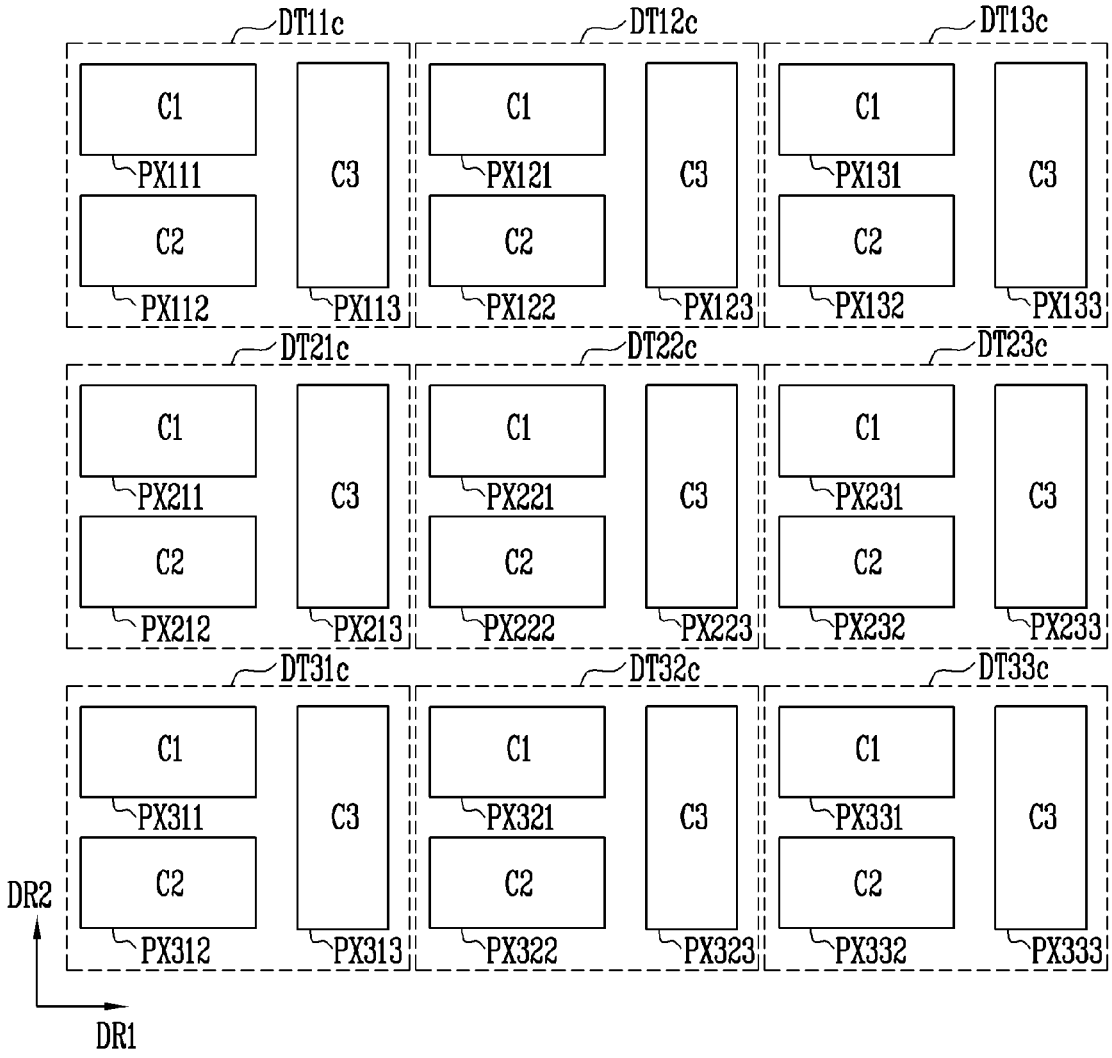
FIGS. 24 and 25 are diagrams for explaining a grayscale correction unit according to an embodiment.
Figure 25:
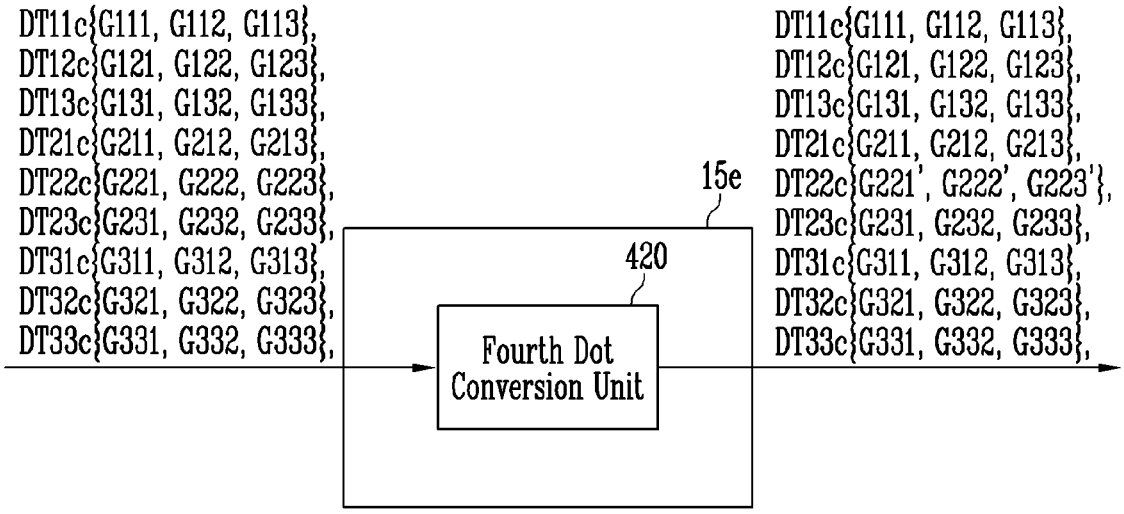

FIGS. 24 and 25 are diagrams for explaining a grayscale correction unit according to an embodiment.

Referring to FIG. 24, among a plurality of dots, a target dot DT22*c* and neighboring dots DT11*c*, DT12*c*, DT13*c*, DT21*c*, DT23*c*, DT31*c*, DT32*c*, and DT33*c* are shown as an example.

The neighboring dots DT11*c* to DT21*c* and DT23*c* to DT33*c* may be dots adjacent to the target dot DT22*c*. For example, other dots may not be disposed between the target dot DT22*c* and the neighboring dots DT11*c* to DT21*c* and DT23*c* to DT33*c*.

In FIG. 24, each of the dots DT11*c* to DT33*c* is shown to have an S-stripe structure. However, even if each of the dots DT11*c* to DT33*c* has the structure of FIGS. 23 and 31 to 34, the RGB stripe structure, or the like, embodiments described below may be applied.

The dots DT11*c* to DT33*c* may be arranged in a matrix form in which a first direction DR1 is a row direction and a second direction DR2 is a column direction. Each of the dots DT11*c* to DT33*c* may include a first pixel of a first color C1, a second pixel of a second color C2, and a third pixel of a third color C3.

The dot DT11*c* may include a first pixel PX111, a second pixel PX112, and a third pixel PX113. The third pixel PX113 may be positioned in the first direction DR1 from the first pixel PX111 and the second pixel PX112, and the first pixel PX111 may be positioned in the second direction DR2 from the second pixel PX112.

The dot DT12*c* may include a first pixel PX121, a second pixel PX122, and a third pixel PX123. The third pixel PX123 may be positioned in the first direction DR1 from the first pixel PX121 and the second pixel PX122, and the first pixel PX121 may be positioned in the second direction DR2 from the second pixel PX122.

The dot DT13*c* may include a first pixel PX131, a second pixel PX132, and a third pixel PX133. The third pixel PX133 may be positioned in the first direction DR1 from the first pixel PX131 and the second pixel PX132, and the first pixel PX131 may be positioned in the second direction DR2 from the second pixel PX132.

The dot DT21*c* may include a first pixel PX211, a second pixel PX212, and a third pixel PX213. The third pixel PX213 may be positioned in the first direction DR1 from the first pixel PX211 and the second pixel PX212, and the first pixel PX211 may be positioned in the second direction DR2 from the second pixel PX212.

The dot DT22*c* may include a first pixel PX221, a second pixel PX222, and a third pixel PX223. The third pixel PX223 may be positioned in the first direction DR1 from the first pixel PX221 and the second pixel PX222, and the first pixel PX221 may be positioned in the second direction DR2 from the second pixel PX222.

The dot DT23*c* may include a first pixel PX231, a second pixel PX232, and a third pixel PX233. The third pixel PX233 may be positioned in the first direction DR1 from the first pixel PX231 and the second pixel PX232, and the first pixel PX231 may be positioned in the second direction DR2 from the second pixel PX232.

The dot DT31*c* may include a first pixel PX311, a second pixel PX312, and a third pixel PX313. The third pixel PX313 may be positioned in the first direction DR1 from the first pixel PX311 and the second pixel PX312, and the first pixel PX311 may be positioned in the second direction DR2 from the second pixel PX312.

The dot DT32*c* may include a first pixel PX321, a second pixel PX322, and a third pixel PX323. The third pixel PX323 may be positioned in the first direction DR1 from the first pixel PX321 and the second pixel PX322, and the first pixel PX321 may be positioned in the second direction DR2 from the second pixel PX322.

The dot DT33*c* may include a first pixel PX331, a second pixel PX332, and a third pixel PX333. The third pixel PX333 may be positioned in the first direction DR1 from the first pixel PX331 and the second pixel PX332, and the first pixel PX331 may be positioned in the second direction DR2 from the second pixel PX332.

Referring to FIG. 25, a grayscale correction unit 15*e* may include a fourth dot conversion unit 420. Here, the grayscale correction unit 15*e* and the fourth dot conversion unit 420 may refer to the same component.

The grayscale correction unit 15*e* may determine a target dot to be corrected, and determine neighboring dots adjacent to the target dot. For example, the grayscale correction unit 15*e* may sequentially determine dots constituting the pixel unit 14 or 14' as the target dot. Here, a case in which the dot DT22*c* is determined as the target dot will be described as an example.

The grayscale correction unit 15*e* (or the fourth dot conversion unit 420) may generate corrected grayscale values G221', G222', and G223' for the target dot DT22*c* by applying weights to grayscale values G221, G222, and G223 of the target dot DT22*c* and grayscale values G111, G112, G113, G121, G122, G123, G131, G132, G133, G211, G212, G213, G231, G232, G233, G311, G312, G313, G321, G322, G323, G331, G332, and G333 of the neighboring dots DT11*c* to DT21*c* and DT23*c* to DT33*c* of the target dot DT22*c* among the dots.

For example, the weights may be stored in advance in the form of a look-up table or the like.

$$FMTX = \begin{bmatrix} F11 & F12 & F13 \\ F21 & F22 & F23 \\ F31 & F32 & F33 \end{bmatrix} \quad \text{Equation 20}$$

Referring to Equation 20, FMTX may include weights F11, F12, F13, F21, F22, F23, F31, F32, and F33. The weights F11, F12, F13, F21, F22, F23, F31, F32, and F33 may be applied to corresponding dots DT11*c*, DT12*c*, DT13*c*, DT21*c*, DT22*c*, DT23*c*, DT31*c*, DT32*c*, and DT33*c*, respectively. FMTX is only a means to easily show the mapping between the weights F11 to F33 and the dots DT11*c* to DT33*c*, and does not mean that the weights F11 to F33 must be stored as data in matrix form.

The fourth dot conversion unit 420 may generate a first corrected grayscale value G221' for the first pixel PX221 of the target dot DT22*c* by applying the weights F11 to F33 to grayscale values G111, G121, G131, G211, G221, G231, G311, G321, and G331 of first pixels PX111, PX121, PX131, PX211, PX221, PX231, PX311, PX321, and PX331 of the target dot DT22*c* and the neighboring dots DT11*c* to DT21*c* and DT23*c* to DT33*c*.

In addition, the fourth dot conversion unit 420 may generate a second corrected grayscale value G222' for the second pixel PX222 of the target dot DT22*c* by applying the weights F11 to F33 to grayscale values G112, G122, G132, G212, G222, G232, G312, G322, and G332 of second pixels PX112, PX122, PX132, PX212, PX222, PX232, PX312, PX322, and PX332 of the target dot DT22*c* and the neighboring dots DT11*c* to DT21*c* and DT23*c* to DT33*c*.

In addition, the fourth dot conversion unit 420 may generate a third corrected grayscale value G223' for the third pixel PX223 of the target dot DT22*c* by applying the weights F11 to F33 to grayscale values G113, G123, G133, G213, G223, G233, G313, G323, and G333 of third pixels PX113, PX123, PX133, PX213, PX223, PX233, PX313, PX323, and PX333 of the target dot DT22*c* and the neighboring dots DT11*c* to DT21*c* and DT23*c* to DT33*c*.

According to an embodiment, in Equation 20, the magnitude of a weight F22 for the target dot DT22*c* may be greater than other weights F11 to F21 and F23 to F33. For instance, a self-grayscale ratio may be large.

According to an embodiment, in Equation 20, the sum of the weights F11 to F33 may be 1. In this case, depending on a product, the weights F11 to F33 may be variably adjusted within a range of 0% to 400%. For example, the weight F11 may be set to 0.0625, the weight F12 may be set to 0.125, the weight F13 may be set to 0.0625, the weight F21 may be set to 0.125, the weight F22 may be set to 0.25, the weight F23 may be set to 0.125, the weight F31 may be set to 0.0625, the weight F32 may be set to 0.125, and the weight F33 may be set to 0.0625.

Since an effect of alleviating the color fringing problem by the fourth dot conversion unit 420 may be similar to the effect of the third dot conversion unit 320 of FIG. 21, duplicate descriptions will be omitted.

Figure 26:
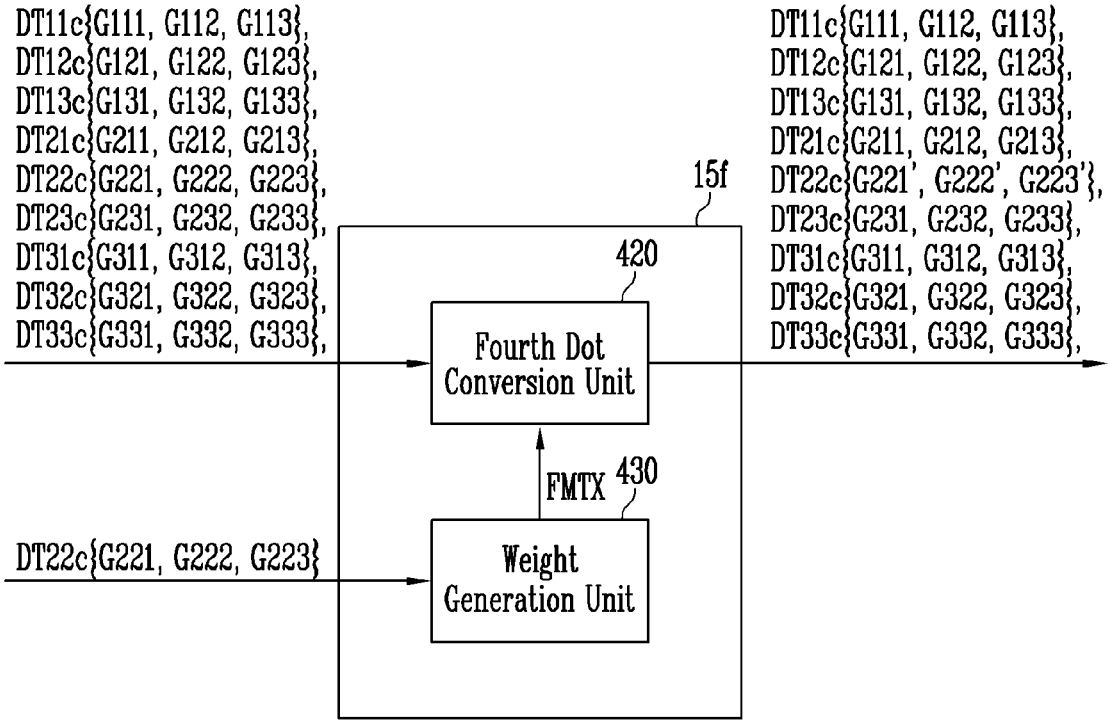
FIGS. 26 and 27 are diagrams for explaining a grayscale correction unit according to an embodiment.
Figures 27, 28:
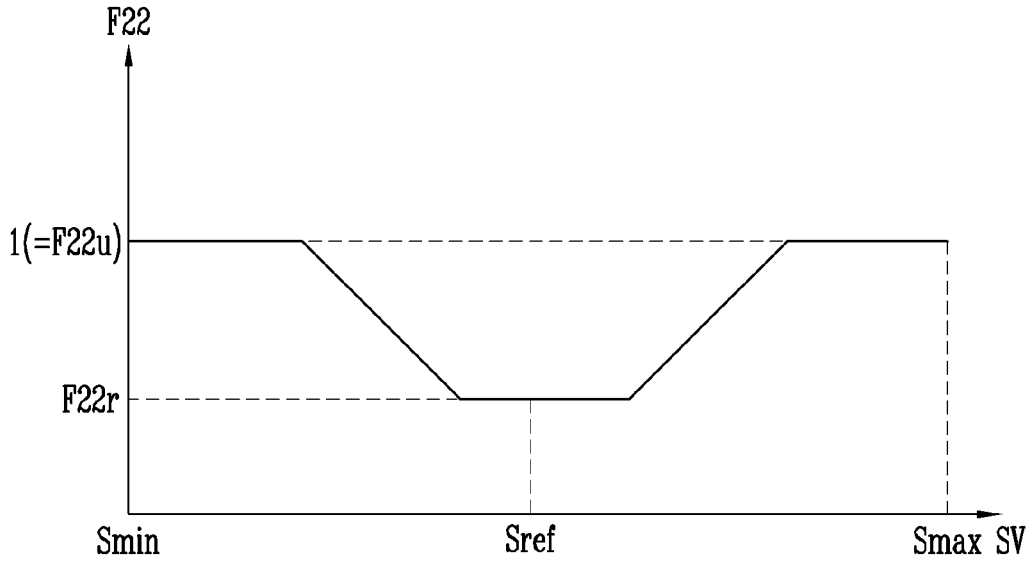
FIGS. 28 to 30 are diagrams for explaining variously set weights when a saturation value is a minimum value according to various embodiments.

FIGS. 26 and 27 are diagrams for explaining a grayscale correction unit according to an embodiment.

Referring to FIG. 26, a grayscale correction unit 15*f* may be different from the grayscale correction unit 15*e* described in association with FIG. 25 in that it further includes a weight generation unit 430. In description of the grayscale correction unit 15*f*, contents overlapping the description of the grayscale correction unit 15*e* will be omitted.

The grayscale correction unit 15*f* may determine weights FMTX based on the grayscale values G221, G222, and G223 of the target dot DT22*c*. In particular, the weight generation unit 430 may calculate a saturation value SV by comparing a first grayscale value G221 for the first pixel PX221, a second grayscale value G222 for the second pixel PX222, and a third grayscale value G223 for the third pixel PX223 of the target dot DT22*c*, and generate the weights FMTX based on the saturation value SV (refer to FIG. 27). The weight generation unit 430 may not use grayscale values G111 to G213 and G231 to G333 of neighboring dots DT11*c* to DT21*c* and DT23*c* to DT33*c* when calculating the saturation value SV. The saturation value SV may be calculated with reference to Equation 21 below.

$$SV=(\max(R,G,B)-\min(R,G,B))/\max(R,G,B) \quad \text{Equation 21}$$

Here, SV may be the saturation value SV and may have a range of 0 to 1. It is noted that max(R, G, B) may mean a maximum value among the first, second, and third grayscale values G221, G222, and G223 of the target dot DT22*c*. Also, min(R, G, B) may mean a minimum value among the first, second, and third grayscale values G221, G222, and G223 of the target dot DT22*c*.

When the saturation value SV is a maximum value (for example, 1), at least one of the first, second, and third grayscale values G221, G222, and G223 of the target dot DT22*c* may be 0. In this case, the target dot DT22*c* may be a case of purely emitting light in the first color, the second color, or the third color, or may be a case of emitting light in a combination of two colors. Referring to FIG. 27, when the saturation value SV is a maximum value Smax, the weight F22 for the target dot DT22*c* may be 1, and the weights F11 to F21 and F23 to F33 for the neighboring dots DT11*c* to DT21*c* and DT23*c* to DT33*c* may be 0. For instance, when the saturation value SV is the maximum value Smax, the color fringing phenomenon may not appear or may hardly appear. Therefore, the corrected grayscale values G221', G222', and G223' of the target dot DT22*c* may be set to be the same as the grayscale values G221, G222, and G223.

When the saturation value SV is a reference value Sref smaller than the maximum value Smax, the first grayscale value G221, the second grayscale value G222, and the third grayscale value G223 of the target dot DT22*c* may all be greater than 0. For example, in this case, as a general display state, the color fringing phenomenon may appear. When the saturation value SV is the reference value Sref, weights F11*r*, F12*r*, F13*r*, F21*r*, F22*r*, F23*r*, F31*r*, F32*r*, and F33*r* for the target dot DT22*c* and the neighboring dots DT11*c* to DT21*c* and DT23*c* to DT33*c* may both be greater than 0 and less than 1. When the saturation value SV is the reference value Sref, the weight F22*r* of the target dot DT22*c* may be greater than the weights for the neighboring dots DT11*c* to DT21*c* and DT23*c* to DT33*c*. As described with reference to FIG. 25, the weight F11*r* may be set to 0.0625, the weight F12*r* may be set to 0.125, the weight F13*r* may be set to 0.0625, the weight F21*r* may be set to 0.125, the weight F22*r* may be set to 0.25, the weight F23*r* may be set to 0.125, the weight F31*r* may be set to 0.0625, the weight F32*r* may be set to 0.125, and the weight F33*r* may be set to 0.0625. In this case, a filter may be applied in the same manner as in the embodiment of FIG. 25 so that the color fringing phenomenon may be improved.

When the saturation value SV is smaller than the maximum value Smax and greater than the reference value Sref, the weights F11 to F33 may be gradually set. For example, as the saturation value SV gradually decreases from the maximum value Smax to the reference value Sref, the weights F11 to F21 and F23 to F33 of the neighboring dots DT11*c* to DT21*c* and DT23*c* to DT33*c* may gradually increase. For example, the weight F11 may gradually increase from 0 to F11*r* (for example, 0.0625). However, the gradients of the weights F11 to F21 and F23 to F33 need not increase uniformly. In some case, even if the saturation value SV is decreased, the weights F11 to F21 and F23 to F33 may remain the same.

Meanwhile, as the saturation value SV gradually decreases from the maximum value Smax to the reference value Sref, the weight F22 for the target dot DT22*c* may gradually decrease. For example, the weight F22 may gradually decrease from 1 to F22*r* (for example, 0.25). However, the gradient of the weight F22 need not decrease uniformly. In some cases, even if the saturation value SV is decreased, the weight F22 may remain the same (refer to FIGS. 28 to 30).

When the saturation value SV is a minimum value Smin smaller than the reference value Sref, weights F11*u*, F12*u*, F13*u*, F21*u*, F22*u*, F23*u*, F31*u*, F32*u*, and F33*u* may be variously set.

Figure 29:
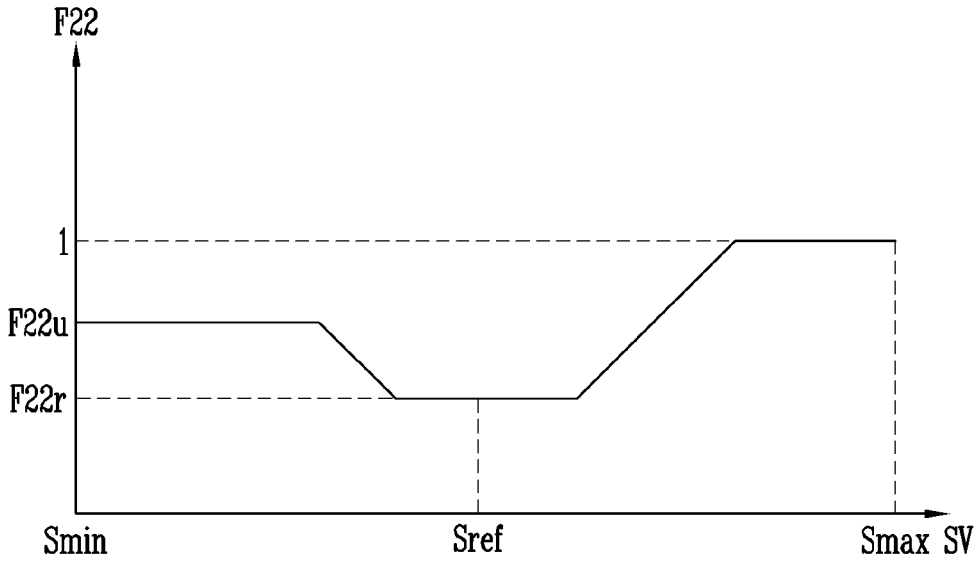
Figure 30:
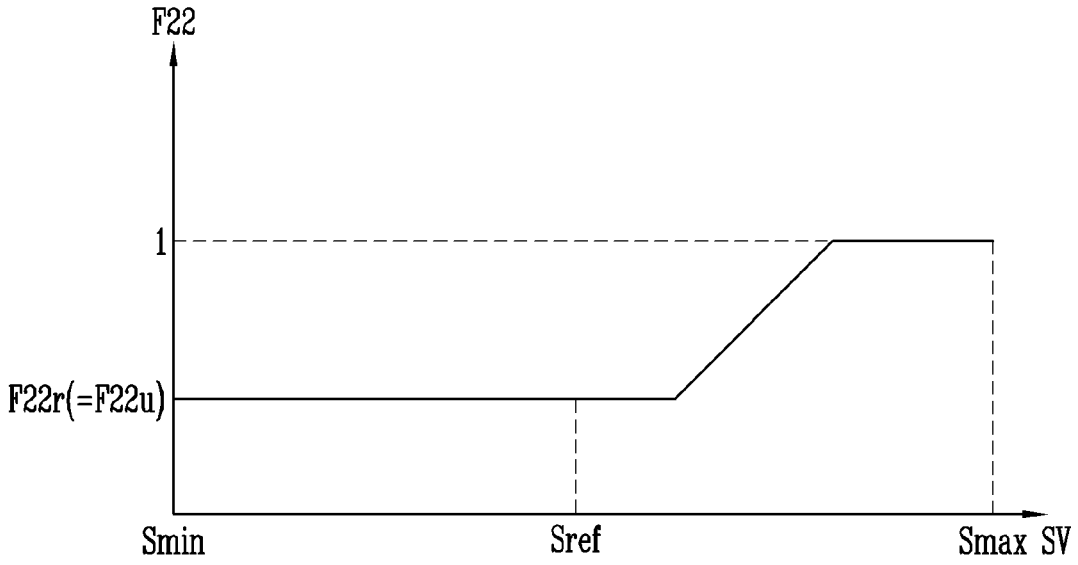

FIGS. 28 to 30 are diagrams for explaining variously set weights when a saturation value is a minimum value according to various embodiments.

Referring to FIGS. 28 to 30, a graph is shown as an example in which the horizontal axis represents the magnitude of the saturation value SV and the vertical axis represents the magnitude of the weight F22. Three graphs may have the same shape when the saturation value SV is greater than the reference value Sref. However, when the saturation value SV is smaller than the reference value Sref, in particular, when the saturation value SV is the minimum value Smin, the three graphs may have different shapes.

When the saturation value SV is the minimum value Smin, the grayscale values G221, G222, and G223 of the first to third colors C1, C2, and C3 of the target dot DT22*c* may be the same, and an achromatic color may be displayed. In this case, the display device 10 may need to improve the color fringing problem depending on the product, or may not need to improve the color fringing problem.

For example, in the case of displaying an achromatic color, the display device 10 may not need to improve the color fringing problem. Referring to FIG. 28, when the saturation value SV is the minimum value Smin, the weights F11*u* to F33*u* of the target dot DT22*c* and the neighboring dots DT11*c* to DT21*c* and DT23*c* to DT33*c* may be the same as the weights when the saturation value SV is the maximum value Smax. For example, the weight F11*u* may be set to 0, the weight F12*u* may be set to 0, the weight F13*u* may be set to 0, the weight F21*u* may be set to 0, the weight F22*u* may be set to 1, the weight F23*u* may be set to 0, the weight F31*u* may be set to 0, the weight F32*u* may be set to 0, and the weight F33*u* may be set to 0.

For example, in the case of displaying an achromatic color, the display device 10 may need to improve the color fringing problem. Referring to FIG. 29, when the saturation value SV is the minimum value Smin, the weights F11*u* to F33*u* of the target dot DT22*c* and the neighboring dots DT11*c* to DT21*c* and DT23*c* to DT33*c* may be intermediate values between the weights F11*r* to F33*r* when the saturation value SV is the reference value Sref and the weights when the saturation value SV is the maximum value Smax. Meanwhile, referring to FIG. 30, when the saturation value SV is the minimum value Smin, the weights F11*u* to F33*u* of the target dot DT22*c* and the neighboring dots DT11*c* to DT21*c* and DT23*c* to DT33 may be the same as the weights F11*r* to F33*r* when the saturation value SV is the reference value Sref.

FIGS. 31 to 34 are diagrams for explaining structures of dots according to various embodiments.

Figure 31:
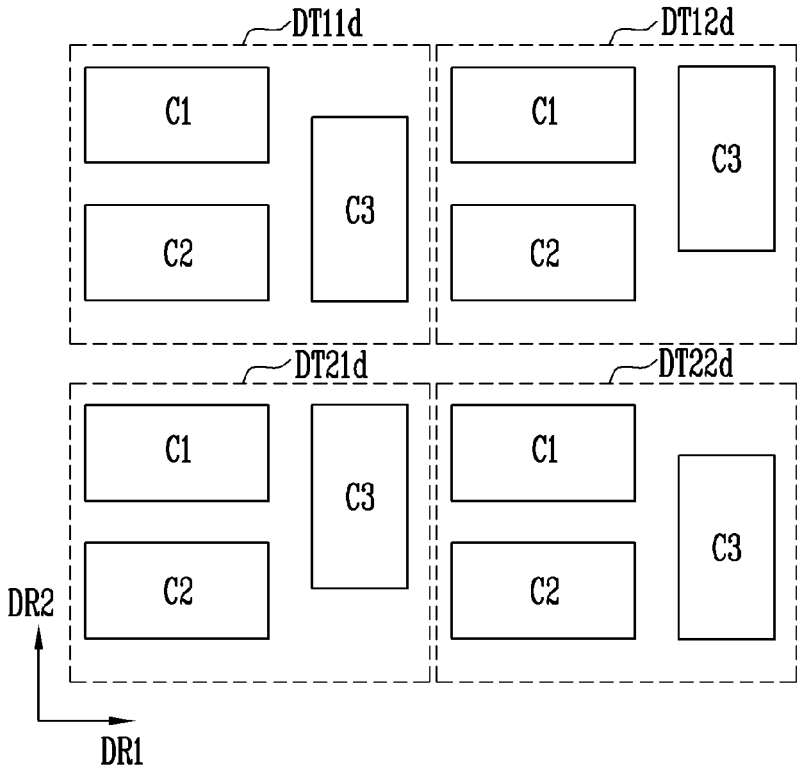
FIGS. 31 to 34 are diagrams for explaining structures of dots according to various embodiments.

Referring to FIG. 31, dots DT11*d*, DT12*d*, DT21*d*, and DT22*d* may be similar to the dots DT7, DT8, DT9, and DT10 described in association with FIG. 20 except for pixels of the third color C3. The pixels of the third color C3 described in association with FIG. 20 may have the same shape and position within all the dots DT7, DT8, DT9, and DT10. Meanwhile, in FIG. 31, a distance between pixels of the third color C3 of the dots DT11*d* and DT21*d* in the second direction DR2 may be different from a distance between pixels of the third color C3 of the dots DT12*d* and DT22*d* in the second direction DR2. For example, the distance between the pixels of the third color C3 of the dots DT11*d* and DT21*d* in the second direction DR2 may be shorter than the distance between the pixels of the third color C3 of the dots DT12*d* and DT22*d* in the second direction DR2. The above-described embodiments may also be applied to the case of FIG. 31.

Figure 32:
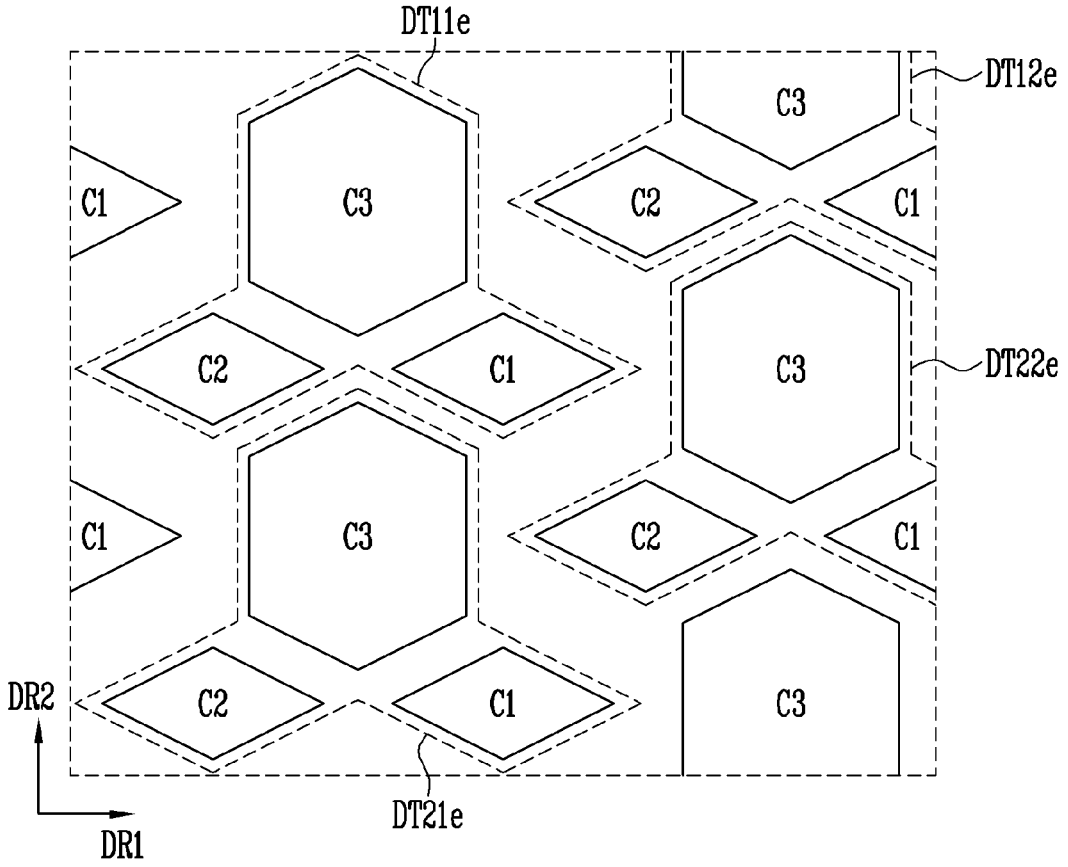

Referring to FIG. 32, each of dots DT11*e*, DT12*e*, DT21*e*, and DT22*e* may include a pixel of the first color C1 having a rhombus shape, a pixel of the second color C2, and a pixel of the third color C3 having a hexagonal shape. The pixel of the first color C1 may be positioned in the first direction DR1 from the pixel of the second color C2, and the pixel of the third color C3 may be positioned in the second direction DR2 from the pixels of the first color C1 and the second color C2. The above-described embodiments may also be applied to the case of FIG. 32.

Figure 33:
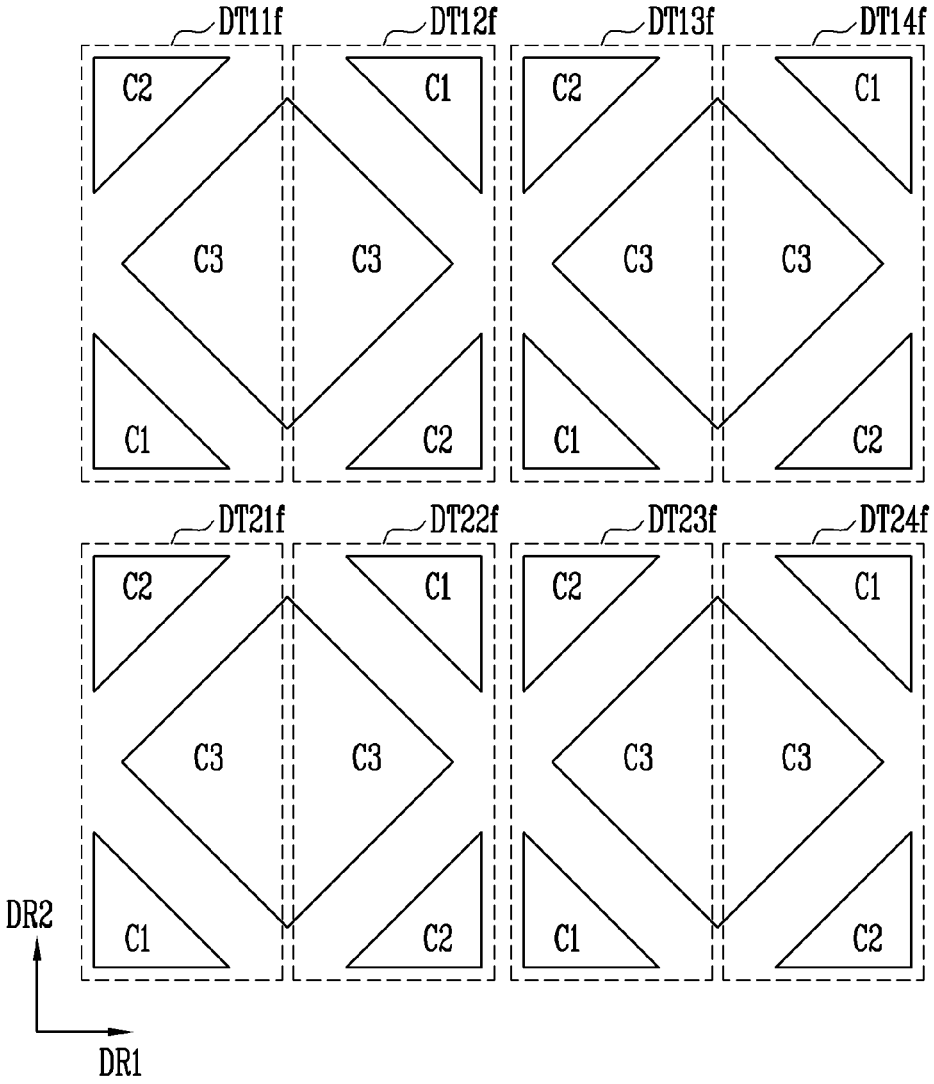

Referring to FIG. 33, in adjacent dots among dots DT11*f*, DT12*f*, DT13*f*, DT14*f*, DT21*f*, DT22*f*, DT23*f*, and DT24*f*, pixels of the third color C3 may share an emission layer. For example, pixels of the third color C3 of the dots DT11*f* and DT12*f* may share an emission layer. For example, the pixels of the third color C3 may have different pixel circuits and different anodes, but may have a common emission layer made of an organic deposition material. The emission layer shared by the pixels of the third color C3 may have a rhombus shape. Meanwhile, the pixel of the first color C1 and the pixel of the second color C2 may have an emission layer having a triangular shape. The above-described embodiments may also be applied to the case of FIG. 33.

Figure 34:
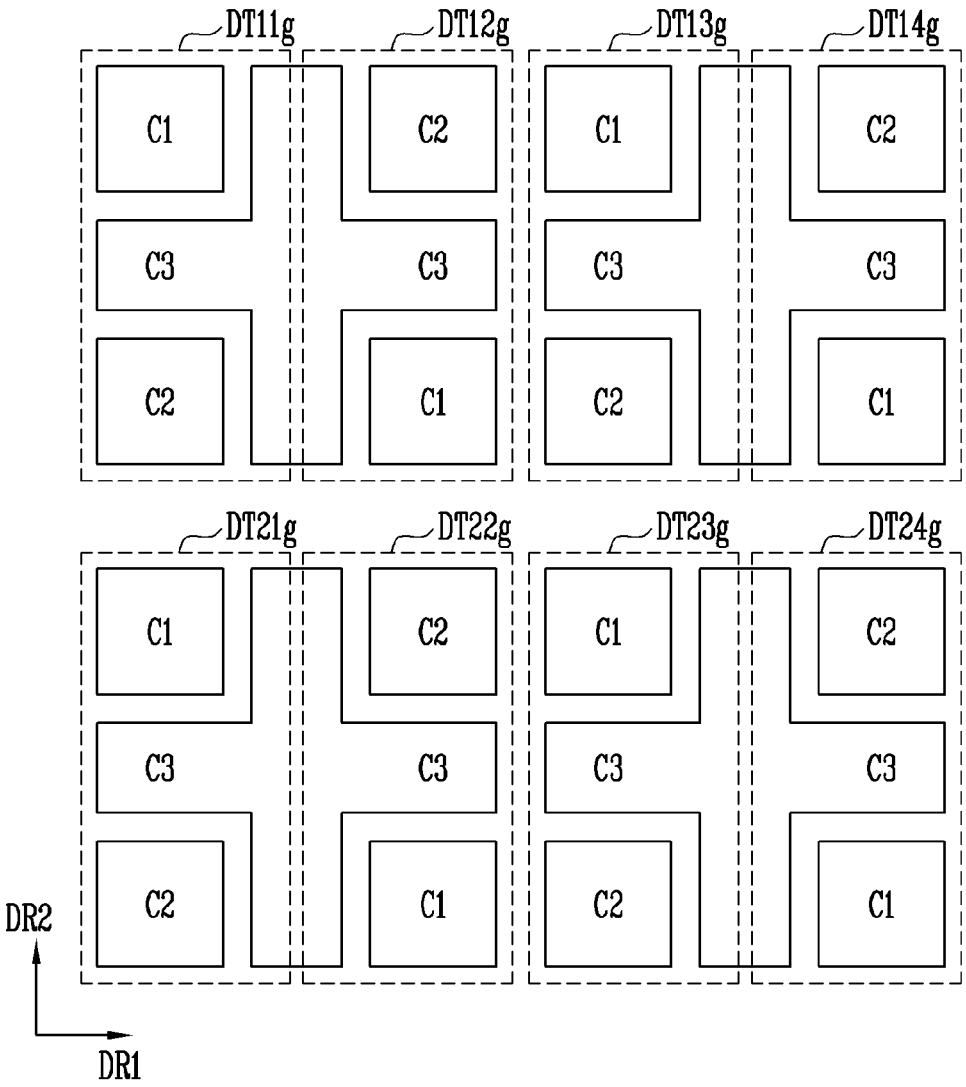

Referring to FIG. 34, in adjacent dots among dots DT11*g*, DT12*g*, DT13*g*, DT14*g*, DT21*g*, DT22*g*, DT23*g*, and DT24*g*, pixels of the third color C3 may share an emission layer. For example, pixels of the third color C3 of the dots DT11*g* and DT12*g* may share an emission layer. For example, the pixels of the third color C3 may have different pixel circuits and different anodes, but may have a common emission layer made of an organic deposition material. The emission layer shared by the pixels of the third color C3 may have a cross shape. Meanwhile, the pixel of the first color C1 and the pixel of the second color C2 may have an emission layer having a rectangular shape. The above-described embodiments may also be applied to the case of FIG. 34.

The display device according to various embodiments can display an image frame in which aliasing is relaxed for various pixel arrangement structures.

Although certain embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A display device comprising:

dots, each dot among the dots comprising a first pixel of a first color, a second pixel of a second color, and a third pixel of a third color; and a grayscale correction unit configured to generate corrected grayscale values for a target dot via application of weights to grayscale values of the target dot and grayscale values of neighboring dots of the target dot among the dots, wherein:

the grayscale correction unit is configured to determine the weights based on the grayscale values of the target dot;

the grayscale correction unit comprises a weight generation unit configured to:

determine a saturation value via comparison of a first grayscale value for the first pixel, a second grayscale value for the second pixel, and a third grayscale value for the third pixel of the target dot; and generate the weights based on the saturation value;

in response to the saturation value being a maximum value, at least one of the first grayscale value, the second grayscale value, and the third grayscale value of the target dot is 0;

in response to the saturation value being the maximum value, a weight for the target dot is 1, and weights for the neighboring dots are 0;

in response to the saturation value being a reference value smaller than the maximum value, the first grayscale value, the second grayscale value, and the third grayscale value of the target dot are all greater than 0; and in response to the saturation value being the reference value, the weights for the target dot and the neighboring dots are both greater than 0 and less than 1.

2. The display device of claim 1, wherein the grayscale correction unit comprises a dot conversion unit configured to generate a first corrected grayscale value for the first pixel of the target dot via application of the weights to grayscale values of first pixels of the target dot and the neighboring dots.

3. The display device of claim 2, wherein the dot conversion unit is configured to generate a second corrected grayscale value for the second pixel of the target dot via application of the weights to grayscale values of second pixels of the target dot and the neighboring dots.

4. The display device of claim 3, wherein the dot conversion unit is configured to generate a third corrected grayscale value for the third pixel of the target dot via application of the weights to grayscale values of third pixels of the target dot and the neighboring dots.

5. The display device of claim 1, wherein the weight generation unit does not use the grayscale values of the neighboring dots in the determination of the saturation value.

6. The display device of claim 1, wherein, in response to the saturation value being the reference value, the weight for the target dot is greater than the weights for the neighboring dots.

7. The display device of claim 6, wherein, in response to the saturation value being a minimum value smaller than the reference value, the weights for the target dot and the neighboring dots are the same as the weights when the saturation value is the maximum value.

8. The display device of claim 6, wherein, in response to the saturation value being the minimum value smaller than the reference value, the weights for the target dot and the neighboring dots are intermediate values between the weights when the saturation value is the reference value and the weights when the saturation value is the maximum value.

9. The display device of claim 6, wherein, in response to the saturation value being the minimum value smaller than the reference value, the weights for the target dot and the neighboring dots are the same as the weights when the saturation value is the reference value.

10. A method of driving a display device, the method comprising:

receiving grayscale values of a target dot and grayscale values of neighboring dots of the target dot among dots of the display device, each dot among the dots comprising a first pixel of a first color, a second pixel of a second color, and a third pixel of a third color;

determining weights based on the grayscale values of the target dot; and generating corrected grayscale values for the target dot by applying the weights to the grayscale values of the target dot and the grayscale values of the neighboring dots of the target dot, wherein:

in determining the weights, a saturation value is determined by comparing a first grayscale value for the first pixel, a second grayscale value for the second pixel, and a third grayscale value for the third pixel of the target dot, and the weights are determined based on the saturation value;

in response to the saturation value being a maximum value, at least one of the first grayscale value, the second grayscale value, and the third grayscale value of the target dot is 0, a weight for the target dot is 1, and weights for the neighboring dots are 0; and in response to the saturation value being a reference value smaller than the maximum value, the first grayscale value, the second grayscale value, and the third grayscale value of the target dot are all greater than 0, and the weights for the target dot and the neighboring dots are both greater than 0 and less than 1.

11. The method of claim 10, wherein the grayscale values of the neighboring dots are not used when determining the saturation value.

12. The method of claim 10, wherein, in response to the saturation value being a minimum value smaller than the reference value, the weights for the target dot and the neighboring dots are the same as the weights when the saturation value is the maximum value.

* * * * *